US006435663B2

(12) United States Patent
Yamaguchi et al.

(10) Patent No.: US 6,435,663 B2
(45) Date of Patent: Aug. 20, 2002

(54) LIQUID DISCHARGE RECORDING APPARATUS, LIQUID DISCHARGE HEAD UNIT, AND MOUNTING METHOD THEREFOR

(75) Inventors: Yukuo Yamaguchi; Shinya Asano, both of Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/813,139

(22) Filed: Mar. 21, 2001

(30) Foreign Application Priority Data

Mar. 31, 2000 (JP) ..... 2000-098670

(51) Int. Cl.[7] ..... B41J 2/175
(52) U.S. Cl. ..... 347/49; 347/87
(58) Field of Search ..... 347/84, 85, 86, 347/87, 49, 108

(56) References Cited

U.S. PATENT DOCUMENTS 5,561,450 A * 10/1996 Brewster, Jr. et al. ..... 347/49
5,764,260 A * 6/1998 Vu et al. ..... 347/87
5,936,740 A 8/1999 Fukazawa et al. ..... 358/296
6,250,750 B1 * 6/2001 Miyazawa et al. ..... 347/87

* cited by examiner

*Primary Examiner*—Anh T. N. Vo
(74) *Attorney, Agent, or Firm*—Fitzpatrick, Cella, Harper & Scinto

(57) ABSTRACT

A liquid discharge head unit is positioned in high precision when mounted on the carriage of a liquid discharge recording apparatus. For the liquid discharge head unit, a side extrusion formed in column, which is rotatively supported in carriage, presses the upper surface of guide ribs formed on both side ends on the upper rear portion. This upper surface is made higher toward the rear side in order to effectuate the substantially horizontal movement of the pressurized position from the front side to the rear side. Then, the liquid discharge head unit is rotated around the side extrusion formed in column so as to be mounted on the carriage smoothly. Lastly, a guide pin, a rear extrusion, and a lower extrusion are allowed to abut against the corresponding portions of the carriage by means of pressure exerted on a receiving rib in order to perform positioning in the front, rear, left, right, up and down directions exactly. Also, by means of pressure exerted on the side face, the side extrusion is allowed to abut against the corresponding portion of the carriage to position the circumference of the guide pin in the rotational direction.

27 Claims, 14 Drawing Sheets

LIQUID DISCHARGE RECORDING APPARATUS, LIQUID DISCHARGE HEAD UNIT, AND MOUNTING METHOD THEREFOR

BACKGROUND OF THE INVENTION

1. Field of the Invention

The present invention relates to a liquid discharge head unit to be mounted on a carriage, which is provided with a liquid discharge head for recording on a recording medium by discharging liquid droplets from discharge ports. The invention also relates to a liquid discharge recording apparatus having the liquid discharge head unit and the carriage mounted thereon, as well as to a method for mounting a liquid discharge head unit.

2. Related Background Art

For the liquid discharge recording apparatus, it has been conventionally practiced to use the liquid discharge head unit which comprises a liquid discharge head for recording on a recording medium by discharging ink from discharge ports integrally formed with an ink tank that contains ink to be supplied to the liquid discharge head or comprises each of them independently.

The liquid discharge recording apparatus is provided with a carriage that reciprocates in the directions almost orthogonal to the carrying direction of a recording medium. The liquid discharge head unit is mounted on this carriage.

As a liquid discharge head, there is known the one which discharges fine liquid droplets utilizing thermal energy generated by means of electrothermal converting devices or the like or the one provided with a pair of electrodes to discharge liquid droplets by deflecting them, among some others. Of these ones, the ink jet recording head that discharges ink liquid droplets utilizing thermal energy makes it possible to arrange in high density the liquid discharge unit (discharge ports) that discharges recording liquid droplets for the formation of flying liquid droplets. This head has already been in practical use with advantages such as to make the entire system compact with ease, besides being able to record in high resolution.

The ink jet recording head that discharges recording liquid by utilization of thermal energy is provided with discharge ports (orifices) that discharge liquid; liquid flow paths communicated with the discharge ports; and a plurality of energy converting elements, such as electrothermal converting devices, arranged corresponding to the liquid flow paths. Then, with the provision of discharge energy (thermal energy for generating film boiling in liquid, for example) by use of the energy converting elements, liquid is discharged from each of the discharge ports to print for recording. Hereunder, with reference to FIG. 14, the description will be made of the general structure of the ink jet recording head.

As shown in FIG. 14, the ink jet recording head comprises an element substrate 1001 provided with heat generating elements 1001*a* each of which is energy generating device for discharging ink; a ceiling plate 1002 which is bonded onto the element substrate 1001; and an orifice plate 1010 bonded to the front end of the element substrate 1001 and the ceiling plate 1002. The element substrate 1001 is fixed by means of die bonding onto a supporting body 1004 formed by aluminum or the like. To the supporting body 1004, a printed circuit board 1003 is adhesively bonded to make contact with the element substrate, and the recording apparatus main body as well. The printed circuit board 1003 and the element substrate 1001 are electrically connected by means of wire bonding. Although not shown in FIG. 14, contact pads are formed for the printed circuit board 1003 in order to make contact with the liquid discharge recording apparatus main body. On the element substrate 1001 together with heat generating elements 1001*a,* driving shift registers and wiring pattern are arranged in addition to the heat generating elements 1001*a*. The shift registers and wiring pattern can be incorporated on the element substrate 1001 together with heat generating elements 1001*a* by use of silicon film formation art.

The ceiling plate 1002 is formed by resin having recessed portions to become ink flow paths 1002*a* and ink chamber 1002*b* integrally formed by means of molding formation or the like or by silicon material formed by means of anisotropic etching or the like. Then, when the ceiling plate 1002 is fixed to the element substrate 1001 by use of pressure means such as spring (not shown) or by bonding means (not shown) using adhesive agent or the like, each of the recessed portions of the ceiling plate 1002 is partitioned to form a plurality of ink flow paths 1002*a* corresponding to each of the heat generating elements 1001*a*, as well as to form the ink liquid chamber 1002*b* to supply liquid to each of the ink flow paths 1002*a*.

In this respect, there is a mode where ink flow paths are formed on the element substrate 1001.

The orifice plate 1010 is provided with a fine ink discharge port group 1010*a* for discharging ink. For the formation thereof, laser processing, electro-casting, press process, molding formation, or some other ultrafine processing is performed. The discharge port group 1010*a* is the important element of a liquid discharge head, upon which depends the discharge performance thereof. In this respect, the orifice plate 1010 is integrally formed with the ceiling plate 1002 or the ceiling plate 1002 is formed as a separate member, and bonded to the orifice plate as the case may be.

In the latter case, the formation method is such that the discharge port group 1010*a* on the orifice plate 1010 is aligned with the ink flow paths 1002*a* formed by pressurized bonding of the element substrate 1001 and the ceiling plate 1002, and then, to bond them together. This has an advantage that the material of the orifice plate 1010 that requires durability can be selected arbitrarily irrespective of the material used for the ceiling plate 1002. On the other hand, in the former case, there is no need for the alignment of both members, because the discharge port group 1010*a* and the ink flow paths 1002*a* are formed by the members arranged in a communicative state, and then, the ceiling plate 1002 having integrally formed with the orifice plate 1010 is bonded simply to the element substrate 1001 under mechanical pressure to form the ink flow paths 1002*a*. This formation method contributes to demonstrating excellent productivity.

The ink jet recording apparatus that uses the head, which is described above, is mainly used as a color printer connected with a word processor or a personal computer. In addition, it is used for a facsimile equipment or a copying machine.

FIG. 15 is a perspective view which shows the conventional liquid discharge head unit (ink jet recording cartridge). As shown in FIG. 15, an ink jet recording head H is mounted on the designated position of an ink jet recording cartridge main body 1130, and adjacent to this ink jet recording head H, a first common liquid chamber 1120 is arranged. The first liquid common chamber 1120 and the ink jet recording head H are supported by supporting members 1121 and 1122. In the interior of the cartridge main body

1130 which is covered by a covering member 1131, a tank (not shown) for use of recording liquid (such as ink) is incorporated to supply recording liquid from the tank to the first common liquid chamber 1120 appropriately.

For an ink jet recording apparatus, there is the one which is of the single head type that discharges monochromatic liquid droplets or the one which is of the single head type or plural head type that discharges liquid droplets in plural colors.

The ink jet recording apparatus of the single head type that discharge liquid droplets in plural colors by allocating ink of plural colors (for example, four colors, black, yellow, magenta, and cyan) to each one head of ink discharge unit, respectively, makes it possible for such head to be manufactured at lower costs. However, the ink jet recording apparatus of such single head type as this has a comparatively small number of discharge ports per color, which presents an disadvantage in making printing speed faster.

In contrast, the ink jet recording apparatus of plural head type makes it possible to arrange a plurality of ink jet recording heads separately and independently per color, although the costs of manufacture should become higher. Here the structure can be arranged so as to discharge liquid droplets of each color from each of the respective recording heads H. It has an advantage then that the number of discharge ports can be made comparatively more per color to make printing speed faster.

Further, there is an ink jet recording apparatus of the combined head type in which a plurality of ink discharge ports are incorporated independently per color on one base. For the apparatus of combined head type, it is arranged to estimate the deviation of each color ink droplet from the other ink droplets in the adhering position, which are discharged from each of the discharge ports arranged per color for the orifice plate. Each of the recording heads is arranged to be incorporated on the base in good precision after correcting each amount of such deviations. With the structure thus arranged, a plurality of recording heads are integrally formed on one base for the ink jet recording apparatus of combined head type, hence making it possible to reduce the deviation of prints per color. This apparatus also has an advantage that heads can be replaced with ease.

FIG. 16 is a perspective view which shows the conventional recording head cartridge of combined head type.

The conventional ink jet recording head assembled body 1306 shown in FIG. 16 comprises a base 1301 provided with a plurality of ink discharge units having ink discharge ports formed therefor, and a printed base plate 1302 having assembled thereon the ROM 1304 which stores the positional data defined per ink discharge unit in accordance with the actually measured data on the positional deviation between ink droplets discharged from the ink discharge ports of each ink discharge unit, as well as the characteristic data of such ink discharge unit own or data for correcting the characteristic of such ink discharge unit.

For the ink jet recording head assembled body 1306, ink supply ports 1303 are arranged to receive ink supply form ink tanks (not shown). For the printed base plate 1302, contact electrodes 1305 are provided. The ink jet recording head assembled body is connected with the control unit of recording apparatus main body through these contacts 1305.

When performing recording operation, the control unit of the recording apparatus executes correction processes with respect to the pulse generating timing and pulse width of driving signal for driving each of discharge energy generating elements that generates discharge energy for discharging ink in accordance with the data stored on the ROM 1304. Thus, it becomes possible to prevent the occurrence of print defects, such as print deviation.

In recent years, it has been required more increasingly to record at higher speed in higher image quality. Printing speed, resolution, and gradation capability therefore should be enhanced still more. In order to make recording possible in the photographic quality, there has been proposed a recording apparatus that implements image recording in high gradation by use of not only the aforesaid four colors, but ink of six colors or seven colors prepared by changing the density of each color.

For the implementation of an ink jet recording apparatus capable of recording at high speed in high quality such as described above, it is desirable to prepare the apparatus in a type where a plurality of ink jet recording cartridges are provided, in a type where combined heads are arranged, or in a type where these are combined together.

Further, in order to implement color recording in high image quality without color unevenness and print deviation, it is necessary to match the impact positions exactly for the ink liquid droplets themselves on a recording medium when discharged from each of the recording heads. Particularly, the arrangement direction of discharge ports, and the correlated deviation between recording heads of each color may exert influence most on the printing quality, and there is a need for mounting recording heads of each color so as to minimize the correlated deviation thereof in the arrangement direction of discharge ports. As an ink jet recording apparatus which is capable of reducing the correlated deviation in the arrangement direction of discharge ports, there has been known the ink jet recording apparatus structured to be able to provide an ink jet recording cartridge with butting portions which abut against the designated portions of the carriage so that the discharge ports of each recording head can be placed exactly on each of the designated positions.

FIG. 17 is a view which shows the conventional example of an ink jet recording cartridge 481 to be mounted on an ink jet recording apparatus of a type in which a plurality of ink jet recording cartridges are arranged side by side and fixed to the carriage.

In the interior of the frame member 482 which is a part to function as housing for the ink jet recording cartridge 481, an ink retaining chamber is arranged to contain ink. On the side face of the frame member 482, the ink supply unit 485 is arranged to be connected with the frame 482 to supply ink to the ink retaining chamber. On the bottom face end 483 of the frame member 482, discharge ports (not shown) are arranged. On the side face of the frame member 482, there are arranged contact pads 484 to be connected with the contacts provided for the carriage on which the ink jet recording cartridge 481 is mounted.

For the frame member 482, extrusions 482*a*, 482*b*, and 482*c* are provided, and with these extrusions 482*a*, 482*b*, and 482*c* abutting against the designated positions on the carriage, the ink jet recording cartridge 481 is positioned and mounted on the carriage.

In other words, with the abutting of the extrusions 482*a* and 482*b*, the ink jet recording cartridge 481 is positioned in the direction X. Then, with the extrusions (not shown) of the carriage arranged on the face opposite to the contact pads 484 which abut against the ink jet recording cartridge, the positioning is made in the direction Y. With the abutting of the extrusion 482*c*, the positioning is made in the direction Z.

For such positioning to be carried out, the carriage is provided with pressure means for enabling the extrusions

482*a,* 482*b,* and 482*c* to abut against the corresponding portions of the carriage. As pressure means in the direction X, an elastic member (not shown) is arranged on the face opposite to the extrusions 482*a* and 482*b*. With this pressure means in the direction X, the wall on the central portion of the extrusions 482*a* and 482*b* is pressed, which is utilized to enable the extrusions 482*a* and 482*b* to abut against the carriage. As to pressure in the direction Y, the structure is arranged so that repulsion occurs against pressure to enable the contact pads 484 to abut against the contacts of the carriage. As to pressure in the direction Z, means (not shown) is arranged for pressing the cartridge 481 downward.

As described earlier, it is necessary for the recording apparatus, which is provided with a plurality of liquid discharge head units mounted corresponding to each ink of plural colors, to mount each of them so as to minimize the correlated deviations in the arrangement direction of discharge ports, because the printing quality is affected significantly by the correlated deviations of each of the liquid discharge head units in the arrangement direction of discharge ports.

In other words, if, for example, one of liquid discharge head units should be mounted with inclination to others for the apparatus provided with a plurality of liquid discharge head units for performing full color recording, the dots recorded by this inclined liquid discharge head unit tend to be formed in superposition on the dots of an adjacent pixel which are recorded by the other liquid discharge head unit, thus resulting in a fear that the quality of recorded image is extremely degraded.

Also, when a liquid discharge head unit, which is provided with a plurality of discharge ports arranged in high density, discharges ink by utilization of pressure changes, the pressure waves may be propagated in the adjacent ink paths in some cases to cause the thermal energy for generating such pressure changes to be dispersed thermally into the adjacent ink paths, thus the phenomenon called cross talk being allowed to occur, thus making ink discharges unstable. In order to suppress such a phenomenon as this, a method may be adopted to divide the discharge port group into plural ones, and drive only either one of the divided groups so that ink is discharged only from the discharge ports contained in that group, not to discharge ink from all the discharge ports at one discharge driving. When such divided driving is executed, the density of pixels of an image that can be formed by one ink discharge becomes low. To counteract this, the recording head may be arranged with inclination in the scanning direction in order to make the density of pixel formation higher to prevent the deterioration of print quality that may be encountered in some cases.

Here, if errors occur in the inclination of recording head in the scanning direction, a problem is encountered that the image quality is degraded. Particularly, for the serial type recording apparatus where one line portion of image recording is performed while the recording head travels in the main scanning direction, and sub-scanning is performed by carrying recording medium subsequently, and then, image recording is executed with the repetition of these operations per sheet, pixels tend to become smaller on the boundary between image areas to be formed by one main scanning by the recording head which is inclined more than a certain degree. Then, such boundary is caused to float out in white eventually.

Therefore, in order to install the recording head on the exact position in high precision, the structure is formed conventionally so that the abutting portions arranged for the designated part of the liquid discharge head unit may abut against the designated portions of the carriage for positioning. However, for this structure, it is required for the junction of the liquid discharge head unit and the carriage to be formed in high precision, which creates such a problem that the costs become higher, and at the same time, the production yield is made unfavorable.

Also, for the conventional structure, the extrusions 482*a* and 482*b* are arranged in the vicinity of one face of the housing (frame member) 482 of the ink jet recording cartridge (liquid discharge head unit) 481, that is, in the vicinity of both edges of the side face, for example, as shown in FIG. 17, and then, the extrusions 482*a* and 482*b* are allowed to abut against the designated portions of the carriage for positioning. In some cases, therefore, the frame member 482 is deformed depending on the way the butting has occurred due to the tolerance of the heights or the inclination of abutting faces between the extrusions 482*a* and 482*b*, and the formation tolerance on the designated portions on the carriage side as well. Because the abutting condition is unstable such as this, it becomes difficult to make the accuracy of installing position higher for the ink jet recording cartridge 481. Here, also, a problem is encountered that the position of installation is made inaccurate after the ink jet recording cartridge 481 is attached or detached. Further, since the structure is arranged so that pressure is substantially exerted uniformly in the vicinity of both edges on each face of the ink jet recording cartridge 481, the anticipated positional regulatory function tends to become smaller against the force that may be exerted on the ink jet recording cartridge 481 when it rotates. As a result, it is subjected to being easily inclined in all the directions, and the resultant problem is such that the correlated deviation tends to occur in the arrangement direction of discharge ports for the mounted liquid discharge heat unit.

Also, in accordance with the conventional structure, the ink jet recording cartridge 481 is positioned by being pressed in the three directions, the friction force, which is generated by the pressure exerted in all the directions, becomes a load that may exert pressure in different directions inevitably. Thus, it is required to provide a considerably large setting load for each of pressure means in order to effectuate abutting firmly against the friction force thus created. As a result, unless a large force is exerted, it is impossible to operate the attachment and detachment of the ink jet recording cartridge 481, and the operativity of attachment and detachment is made inferior after all. Further, the robustness of the frame member 482 should be made greater in order to withstand such high load, which brings about the higher manufacturing costs of the apparatus as a whole. Also, with the structure, in which the ink jet recording cartridge 481 is pressed with high load, only parts of the extrusions 482*a* and 482*b* are conditioned to abut against the carriage because of the influence which is exerted by friction force or the like. Thus, there is a fear that the ink jet recording cartridge 481 remains in such a condition as it is when mounted.

Also, in accordance with the conventional structure, the contact pads 484 move up and down in a state of being pressed to the facing contacts on the carriage when the ink jet recording cartridge 481 is attached to and detached from the carriage. Then, there is a fear that the contact pads 484 are damaged by rubbing. To counteract this, a hard surface coating is provided for junctions of the contact pads and carriage or an expensive material should be is used for the enhancement of durability. This also causes the costs of manufacture to rise inevitably.

Meanwhile, the combined head type as shown in FIG. 16, that is, the ink jet recording apparatus having the ink jet recording head assembled body 1306 installed thereon, makes it possible to execute an integrated assembling of ink discharge units of plural colors in the corresponding manufacturing steps. As a result, unlike the case where a plurality of liquid discharge head units are used, no problem is encountered as to the aspect of the correlated positional precision needed for ink discharge units of each color. However, there are still problems as given below.

In other words, firstly, as compared with the case where a liquid discharge head unit, which is provided with monochromatic ink discharge ports, is prepared in plural color numbers, the productivity becomes unfavorable, because the yield of the ink jet recording head assembled body 1306 is simply the product of yields of the plural color ink discharge ports to be assembled.

Secondly, when the replacement of recording heads is required, the ink jet recording head assembled body 1306 should be replaced entirely for the recording apparatus of assembled head type, whereas for the recording apparatus that mounts plural liquid discharge head units, it is good enough to replace only those which require the replacements individually. As a result, replacement costs become comparatively high for the apparatus of assembled head type.

Thirdly, when manufacturing the ink jet recording head assembled body 1306, there is a need for assembling each of the color ink discharge ports with highly precise positional correlations taken into consideration. As a result, the costs of manufacture becomes comparatively high.

SUMMARY OF THE INVENTION

With a view to solving these problems discussed above, the present invention is designed. It is the object of the invention to provide a liquid discharge recording apparatus capable of mounting a liquid discharge head unit on a carriage in high positional precision, and also, to provide a liquid discharge head unit, as well as a method for mounting such liquid discharge unit.

In order to achieve the object described above, the liquid discharge recording apparatus of the present invention is provided with a liquid discharge head for discharging a liquid droplet from a plurality of discharge ports to record on a recording medium, a liquid discharge head unit integrally formed with a housing to hold the liquid discharge head, and a carriage capable of detachably mounting the liquid discharge head unit thereon. In this liquid discharge recording apparatus, a liquid discharge head unit comprises a columned guide pin arranged in the central portion of the rear bottom face in the widthwise direction to be extended downward; a rear extrusion arranged in the central portion of the upper backside face in the widthwise direction, having a spherical surface convexly toward rear side; a columned extrusion and a side extrusion arranged on the front part of side face; a pair of guide ribs arranged on both side ends or in the vicinity of both side ends on the upper rear portion to face each other, each having inclined upper surface made higher toward the rear side; and a receiving rib arranged in the central portion in the widthwise direction, being connected with the guide ribs on the rear side of the guide ribs, and having the inclined surface lowered once, and then, made higher toward the rear side, and a carriage comprises: a guide groove capable of sliding the liquid discharge head unit in a state of being in contact with the columned extrusion to be guided into a head unit mounting space, and holding the unit in that position rotatively centering on the columned extrusion; a head set plate for pressing the upper surface of the guide ribs so as to effectuate the substantially horizontal movement of the pressurized position of the liquid discharge head unit from the front side to the rear side at the time of being mounted on the carriage, and pressing the receiving rib after the liquid discharge head unit is mounted on the carriage; a first rib portion in U-letter or V-letter form to abut against the face of the guide pin in a state of the liquid discharge head unit being mounted on the carriage; a second rib portion in U-letter or V-letter form to abut against the spherical surface of the rear extrusion; a receiver abutting against the front extrusion; and a CR head spring to press the liquid discharge head unit to enable the side extrusion to abut against the receiver.

With the structure thus arranged, it becomes possible to insert the liquid discharge head unit into a head unit mounting space by sliding the columned extrusion in a state of being in contact with the guide groove, and rotate the liquid discharge head unit with the columned extrusion as axis by pressing the upper surface of the guide ribs with the head set plate so as to effectuate the substantially horizontal movement of the pressurized position from the front side to the rear side, thus guiding the liquid discharge head unit to an appropriately angled position on this axial circumference. Further, it becomes possible to position the front, rear, left, and right sides of the liquid discharge head unit exactly by moving the pressurized position further to the rear side, and press the upper surface of the receiving rib by use of the head set plate lastly, thus enabling the side face of the guide pin to abut against the first rib portion, and the rear extrusion again the second rib portion. In this state, the side face of the liquid discharge head unit is pressed by the CR spring to enable the side extrusion to abut against the receiver of the carriage, hence making the angled position appropriate within the horizontal plane in the front and rear directions of the liquid discharge head unit for mounting the liquid discharge head unit on the carriage.

In accordance with the structure described above, a pair of guide ribs are arranged on both side ends on the upper surface or in the vicinity of both ends to enable the liquid discharge head unit to rotate stably without inclination to the left or right in the vertical direction when the liquid discharge head unit is rotated while being pressed to this upper surface, hence being guided to an appropriate position.

In this case, the guide ribs are arranged so as to make each distance equal from the center of the receiving rib to the guide ribs on both ends in the widthwise direction, respectively. Then, with pressure exerted on the guide ribs on both ends, the moment of inclination to the left and right is equalized for the liquid discharge head unit in the vertical direction, thus effectively controlling the unsteadiness of the liquid discharge head unit so as not to be inclined to the left or right in that direction.

Here, it is preferable to connect the guide ribs and the receiving rib smoothly in order to move the pressurized position smoothly when it moves to the rear side by means of the head set plate which is able to transfer it from the upper surface of the guide ribs to the upper surface of the receiving rib.

More specifically, the structure whereby to press the upper surfaces of the guide ribs and receiving rib is such that the head set plate is provided with the leading end portion extruding downward, a shaft formed on the rear portion, and a spring receiver formed on the upper surface; and also, provided with a CR lever for supporting the shaft of the head set plate rotatively in the vicinity of the lower leading end, while being supported rotatively around the axis of CR lever shaft arranged on the foot thereof, to guide the head set plate to a position to be in contact with the upper surface of the liquid discharge head unit; and a CD set plate spring connected with the bottom face of the CR lever, and the spring receiver of the head set plate. With the structure thus arranged, when the CR lever is rotated, the leading end portion of the head set plate presses the upper surface of the guide ribs by means of the CR set plate spring so as to effectuate the substantially horizontal movement of the pressurized position from the front side to the rear side.

For the liquid discharge recording apparatus of the present invention, if it is arranged to enable the liquid discharge head unit to rotate while keeping the state in which the guide pin abuts against the first rib portion, and the rear extrusion abuts against the second rib portion, the liquid discharge head unit can rotate smoothly without displacing the front, rear, left and right positions thereof when the side extrusion is caused to abut against the receiver of the carriage by means of the CR head spring.

In order to make such rotation possible, the center of the spherical surface of the rear extrusion is positioned on the extended line of the center line of the column of the guide pin, for example. In other words, with the structure thus arranged, the liquid discharge head unit can be kept rotatively with the center of the column of the guide pin as axis in a state where the guide pin abuts against the first rib portion, and the rear extrusion abuts against the second rib portion.

In this case, with the arrangement to enable the center of the receiving rib in the widthwise direction to be positioned on the extended line of the center line of the column of the guide pin, the pressure is exerted by the head set plate along the rotational axis, that is, along the extended line from the center line of the column of the guide pin, thus making the liquid discharge head unit stably rotative around the rotational axis thereof. Here, it is desirable to make the contact area between the receiving rib and the head set plate small so that no friction force between the receiving rib and the head set plate may impede rotation. For this purpose, it is particularly desirable to make the width of the receiving rib 2 mm or less.

Also, for the present invention, if the structure is arranged so that the liquid discharge head unit is provided with a lower extrusion arranged on the rear side of the bottom face, having spherical surface convexly downward, and that the carriage is provided with a boss having flat upper face to abut against the spherical surface of the side extrusion in a state of the liquid discharge head unit being mounted on the carriage, it becomes possible to position the liquid discharge head unit appropriately in the vertical direction by enabling the spherical surface of the side extrusion to abut against the upper surface of the boss by means of the pressure exerted by the head set plate.

Here, it is preferable for the guide pin to be provide with tapered portion becoming narrower toward the leading end so that the side face of the guide pin is guided to an appropriate position to abut against the first rib portion when the liquid discharge head unit rotates by means of the pressure exerted by the head set plate.

Also, if the structure is arranged for the liquid discharge recording apparatus of the present invention so that the liquid discharge head unit is provided with contact pads formed on the backside thereof for electrical connection, and that the carriage is provided with a CR connector to be connected with the contact pads, there is almost no possibility that the contact pads and the CR connector are caused to rub each other, because the liquid discharge head unit has the upper surface inclined upward so as to enable the receiving rib to be made higher toward the rear side, thus being pressed diagonally downward to the rear side by the pressure exerted by the head set plate. Here, the contact pads and CR connector abut against each other reliably for connection, and also, the liquid discharge head unit rotates so as to abut against the rear side.

For the liquid discharge recording apparatus of the present invention, the structure is arranged so that the abutting surface of the side extrusion, guide pin, and lower extrusion is a spherical surface or a columned surface, and that positioning is made by the contact between the surface having such curve, and the flat surface in order to position the liquid discharge head unit appropriately. Therefore, the abutting condition is not easily affected by the deviation that may occur in the contacting direction due to distortion or difference in contacting force. As a result, the liquid discharge head unit can be positioned in high precision with good reproducibility. It is preferable to arrange the structure as has been described as to the side extrusion. More specifically, the abutting surface of the side extrusion against the receiver should preferably be one face formed in sphere, curve, or polygon.

The liquid discharge head unit of the present invention is detachably mountable on a carriage of a liquid discharge recording apparatus main body integrally formed with a liquid discharge head for discharging liquid droplets from a plurality of discharge ports to record on a recording medium, and with a housing to hold the liquid discharge head unit, which comprises a columned guide pin arranged in the central portion of the rear bottom face in the widthwise direction to be extended downward; a rear extrusion arranged in the central portion of the upper backside face in the widthwise direction, having a spherical surface convexly toward rear side; a columned extrusion and a side extrusion arranged on the front part of side face; a pair of guide ribs arranged on both side ends or in the vicinity of both side ends on the upper rear portion to face each other, each having inclined upper surface made higher toward the rear side; and a receiving rib arranged in the central portion in the widthwise direction, being connected with the guide ribs on the rear side of the guide ribs, and having the inclined surface lowered once, and then, made higher toward the rear side. For this liquid discharge head unit, the columned extrusion supports the liquid discharge head unit rotatively with the columned extrusion as axis; the guide ribs enable the liquid discharge head unit to rotate with the columned extrusion as axis so as to be guided to an appropriately angled position, while the upper surface thereof is pressed to effectuate the substantially horizontal movement of the pressurized position from the front side to the rear side; the receiving rib enables the liquid discharge head unit to be pressed toward diagonally lower rear side when the pressurized position moves further to the rear side to arrive at the upper surface thereof, and enables the side face of the guide pin to abut against the spherical surface of the rear extrusion; the guide pin and the rear extrusion enable the front, rear, left, and right sides of the liquid discharge head unit to be positioned exactly when the side face of the guide pin and the spherical surface of the rear extrusion abut against the carriage, and at the same time, hold the liquid discharge head unit rotatively while keeping the abutting condition thereof; and the side extrusion enables the liquid discharge head unit to abut against the carriage to make the angled position appropriately in the rotational direction when the side face of the guide pin and the spherical surface of the rear extrusion rotate while keeping the abutting condition.

The method of the present invention for mounting a liquid discharge head unit on a liquid discharge recording apparatus referred to in the preceding paragraphs comprises the steps of inserting the liquid discharge head unit into a head unit mounting space by sliding the columned extrusion in a state of being in contact with the guide groove; rotating the liquid discharge head unit around the columned extrusion as axis by pressing the upper surface of the guide ribs by the head set plate so as to effectuate the substantially horizontal movement of the pressurized position from the front side to the rear side; pressing the upper surface of the receiving rib lastly by means of the head set plate by moving the pressurized position further in order to enable the side face of the guide pin to abut against the first rib portion, and the spherical surface of the rear extrusion to abut against the second rib portion; and pressing subsequently the side face of the liquid discharge head unit by use of the CR spring to rotate the liquid discharge head unit around the column of the guide pin with the center line thereof as axis for enabling the side extrusion to abut against the receiver.

DETAILED DESCRIPTION OF THE PREFERRED EMBODIMENTS

Hereinafter, with reference to the accompanying drawings, the description will be made of embodiments in accordance with the present invention.

Figure 1:
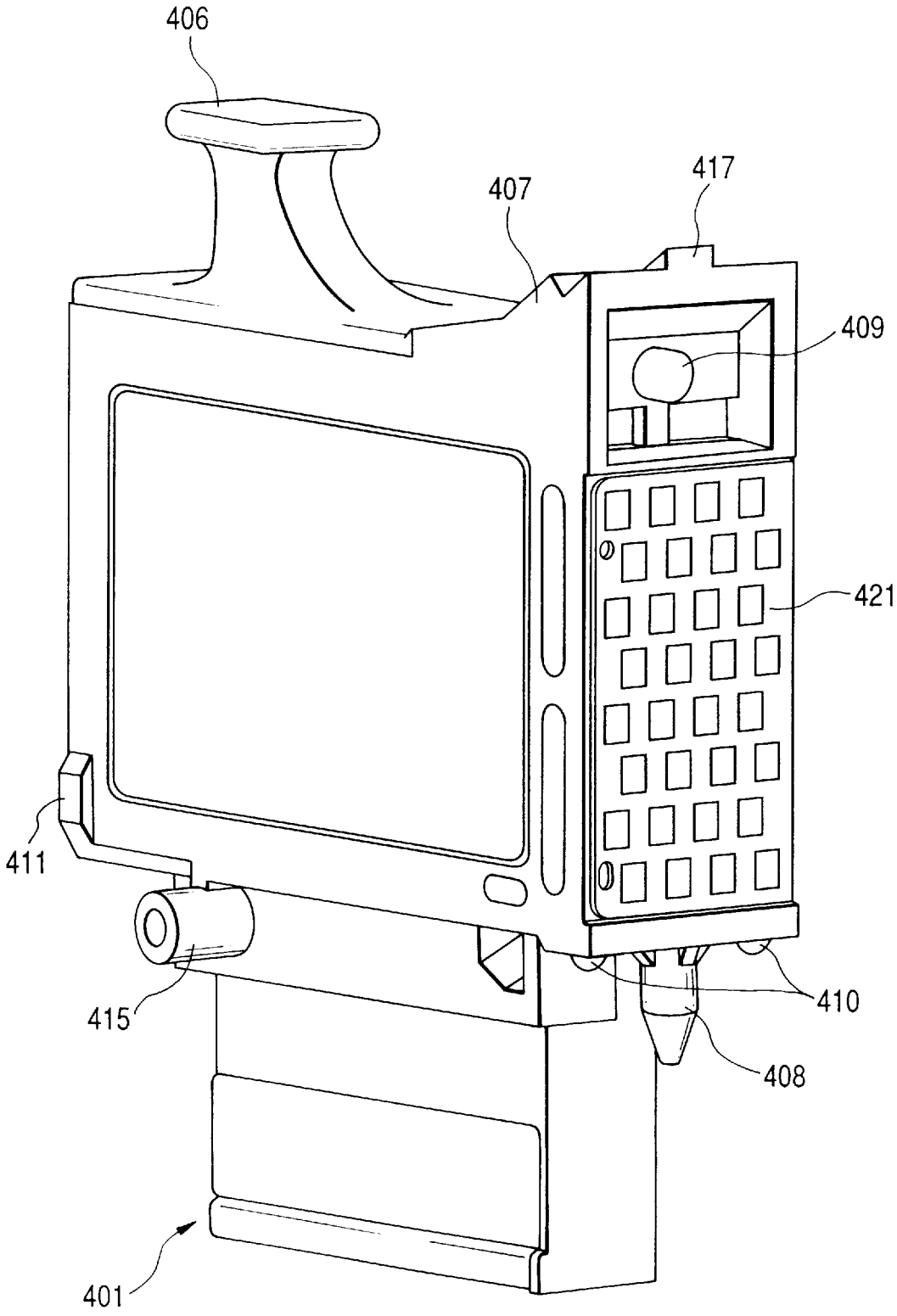
FIG. 1 is a perspective view which shows a liquid discharge head unit embodying the present invention, observed from the left rear side thereof.
Figure 2:
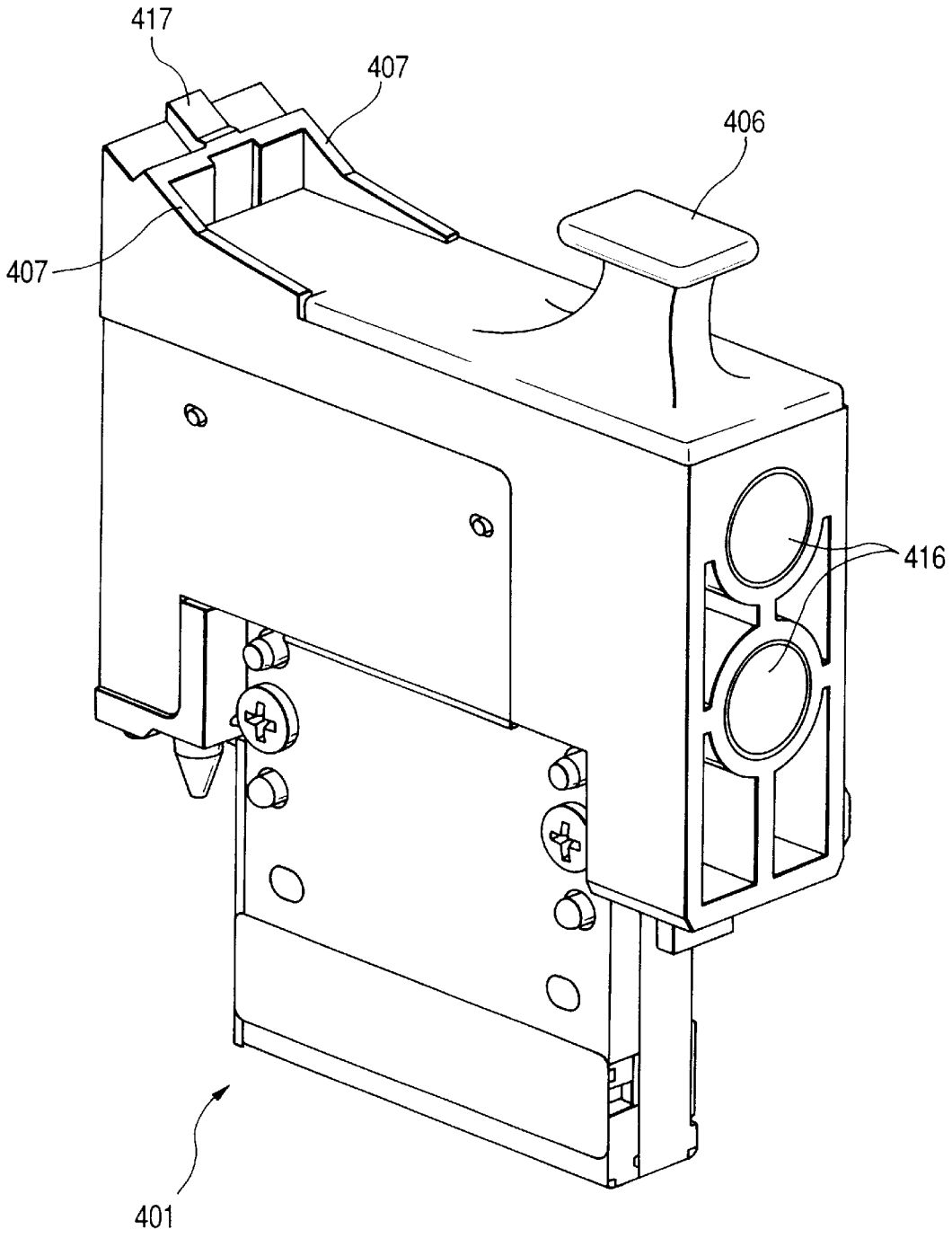
FIG. 2 is a perspective view which shows the liquid discharge head unit represented in FIG. 1, observed from the right front side thereof.
Figure 3:
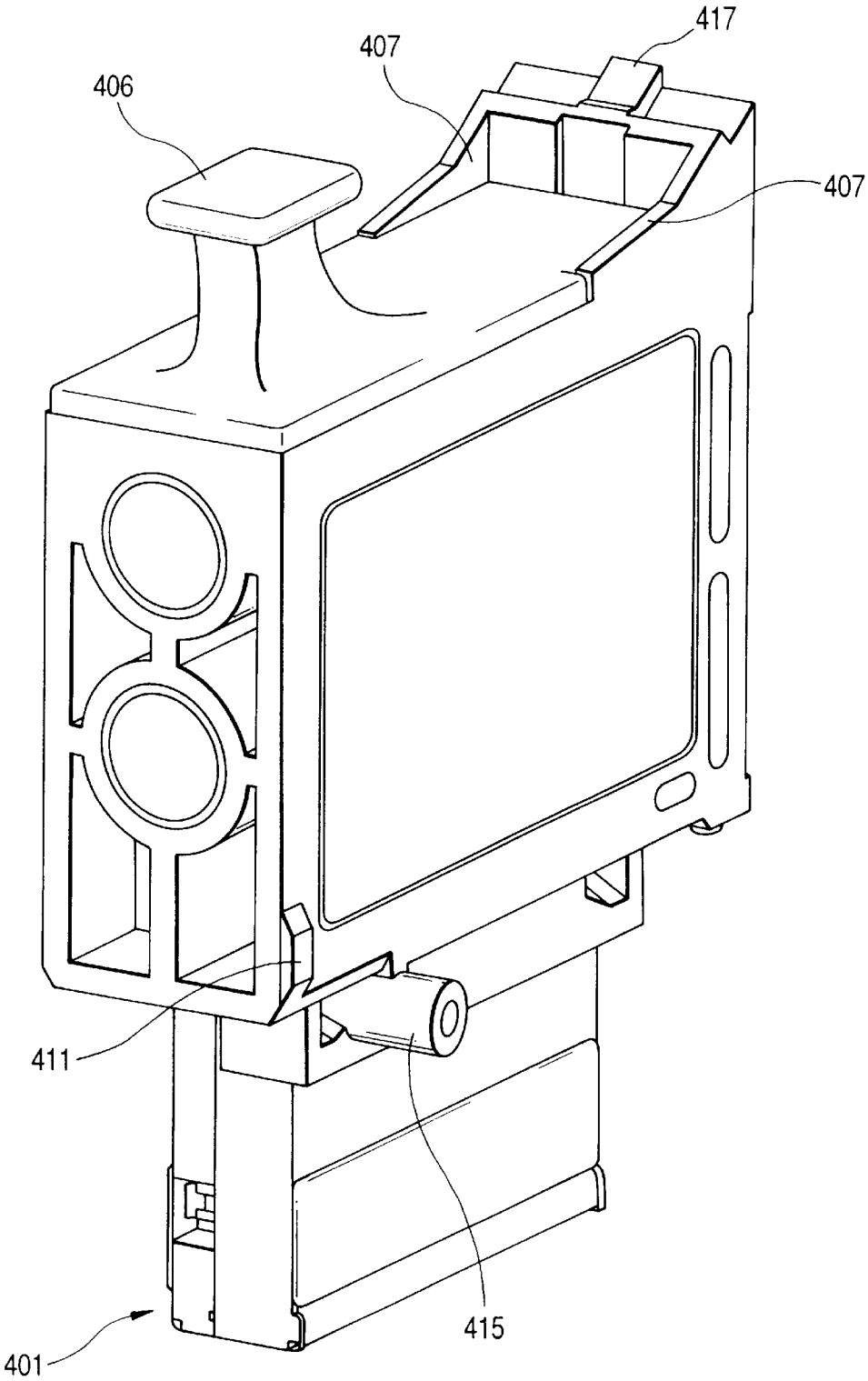
FIG. 3 is a perspective view which shows the liquid discharge head unit represented in FIG. 1, observed from the left front side thereof.

FIG. 1 to FIG. 3 illustrate the liquid discharge head unit of the present embodiment. The side face where contact pads 421 are arranged is defined as the rear side or backside. The side face where the joint portions 416 are arranged is defined as the front side. The side face where the handle 406 is arranged is defined as the upper part, and the side face where the head is arranged is, the lower part. A first side face of those connecting the contact pads and the joint portions is defined as the left side face, observed from the contact pad side, and a second side face opposite thereto is, the right side face. Hereinafter, the description will be made in accordance with such definition as up and down, left and right, front and rear as described above.

Figure 4:
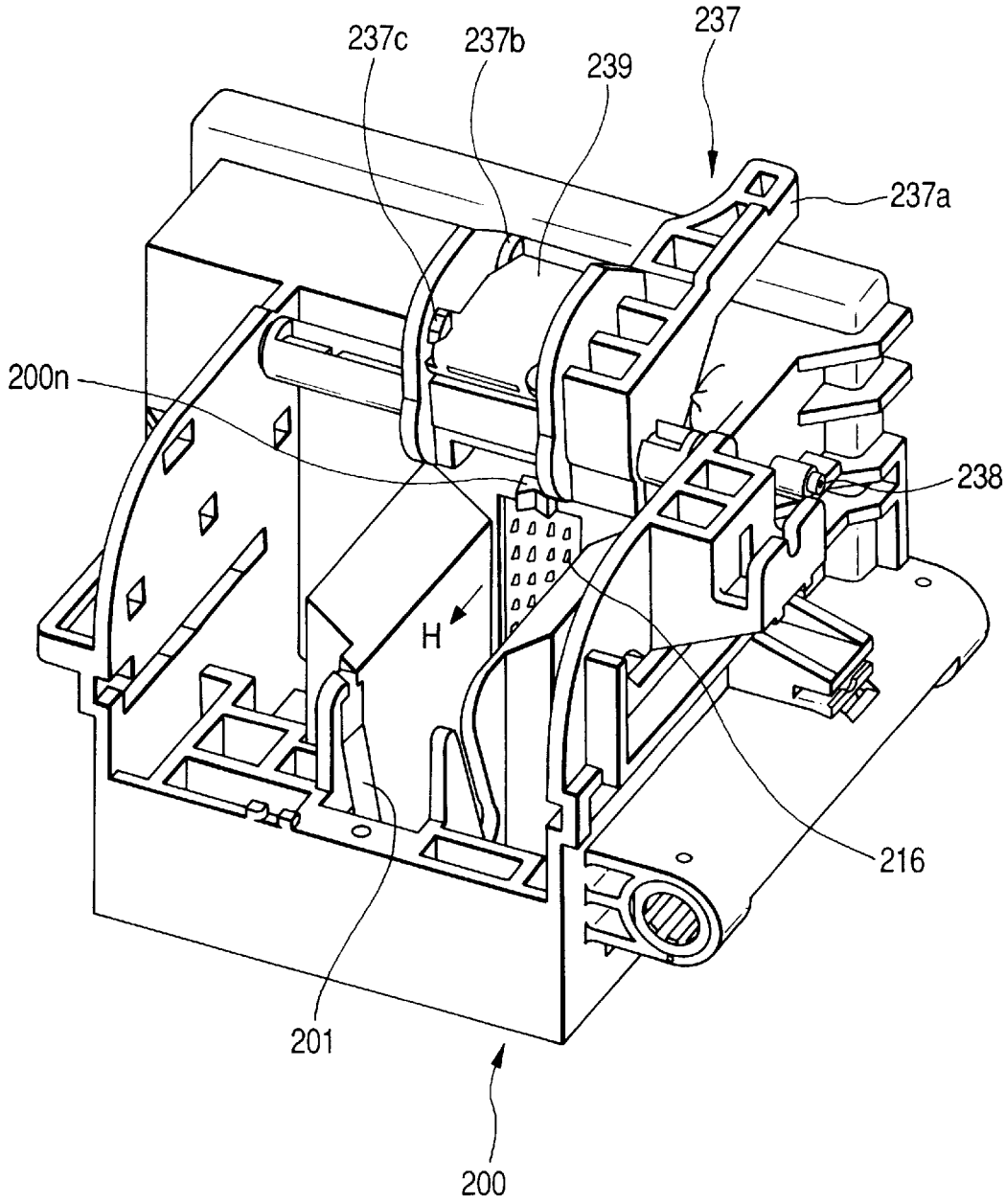
FIG. 4 is a perspective view which shows a carriage on which is mounted the liquid discharge head unit represented in FIG. 1.
Figure 5:
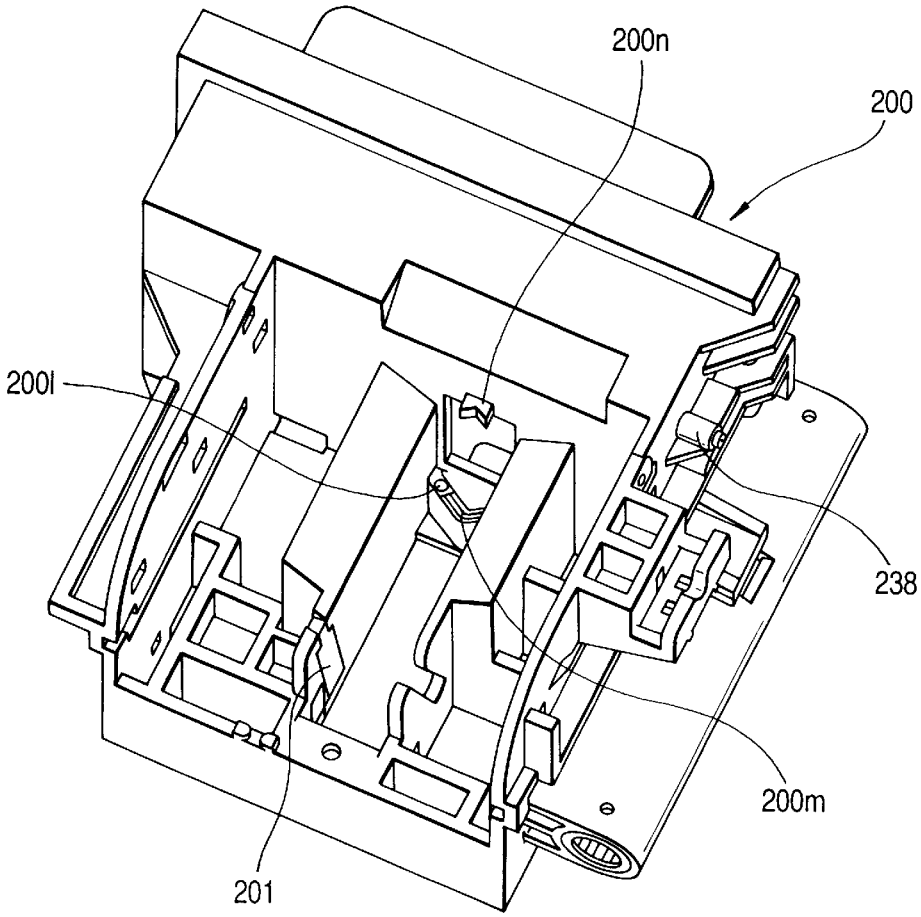
FIG. 5 is a perspective view which shows the carriage represented in FIG. 4, observed in the other direction.
Figure 6:
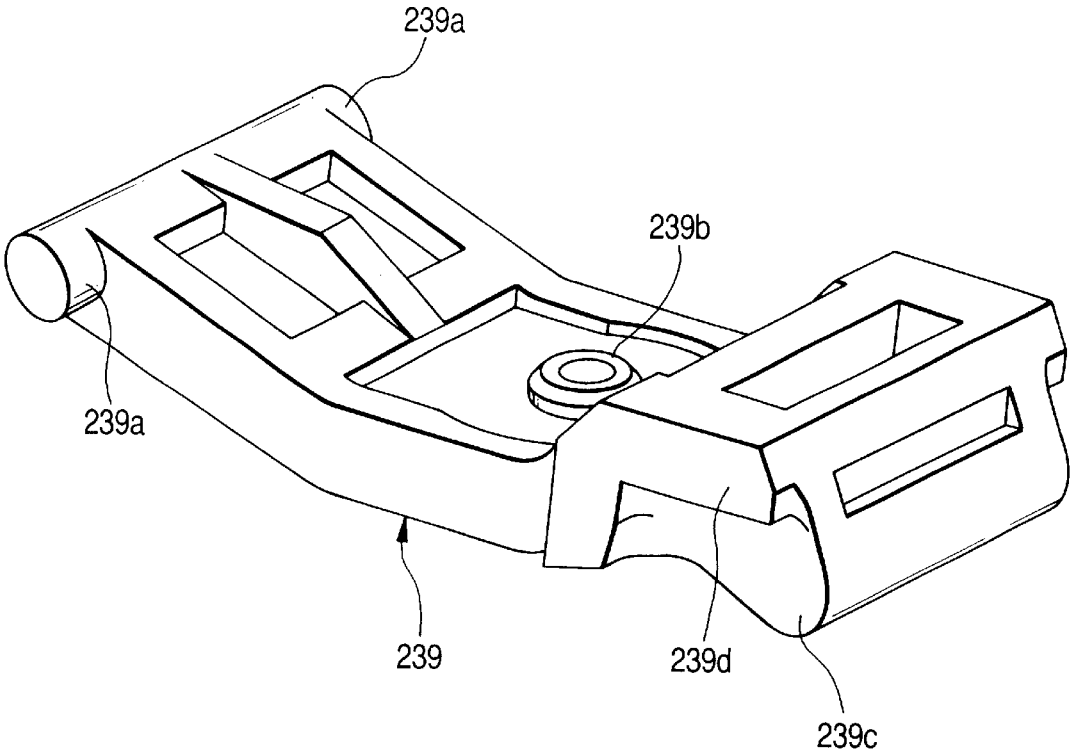
FIG. 6 is a perspective view which shows the head set plate of the carriage represented in FIG. 3.
Figure 7:
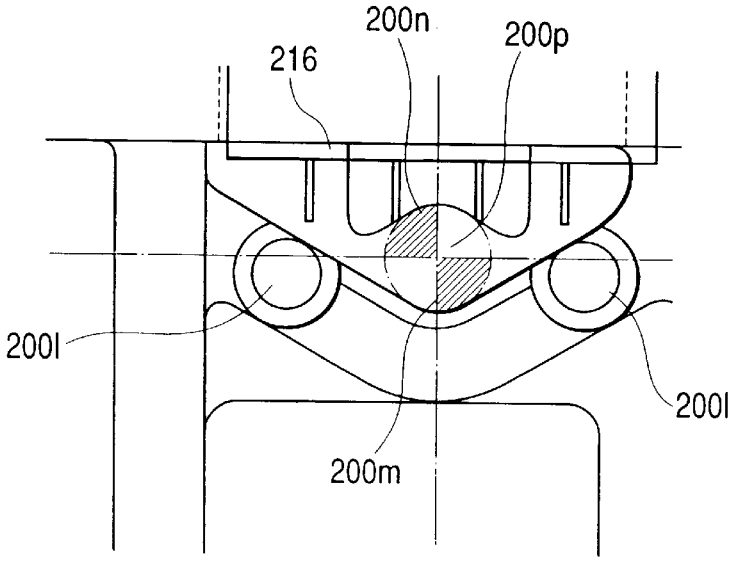
FIG. 7 is an enlarged plan view which shows the vicinity of the CR connector of the carriage represented in FIG. 3.
Figure 8:
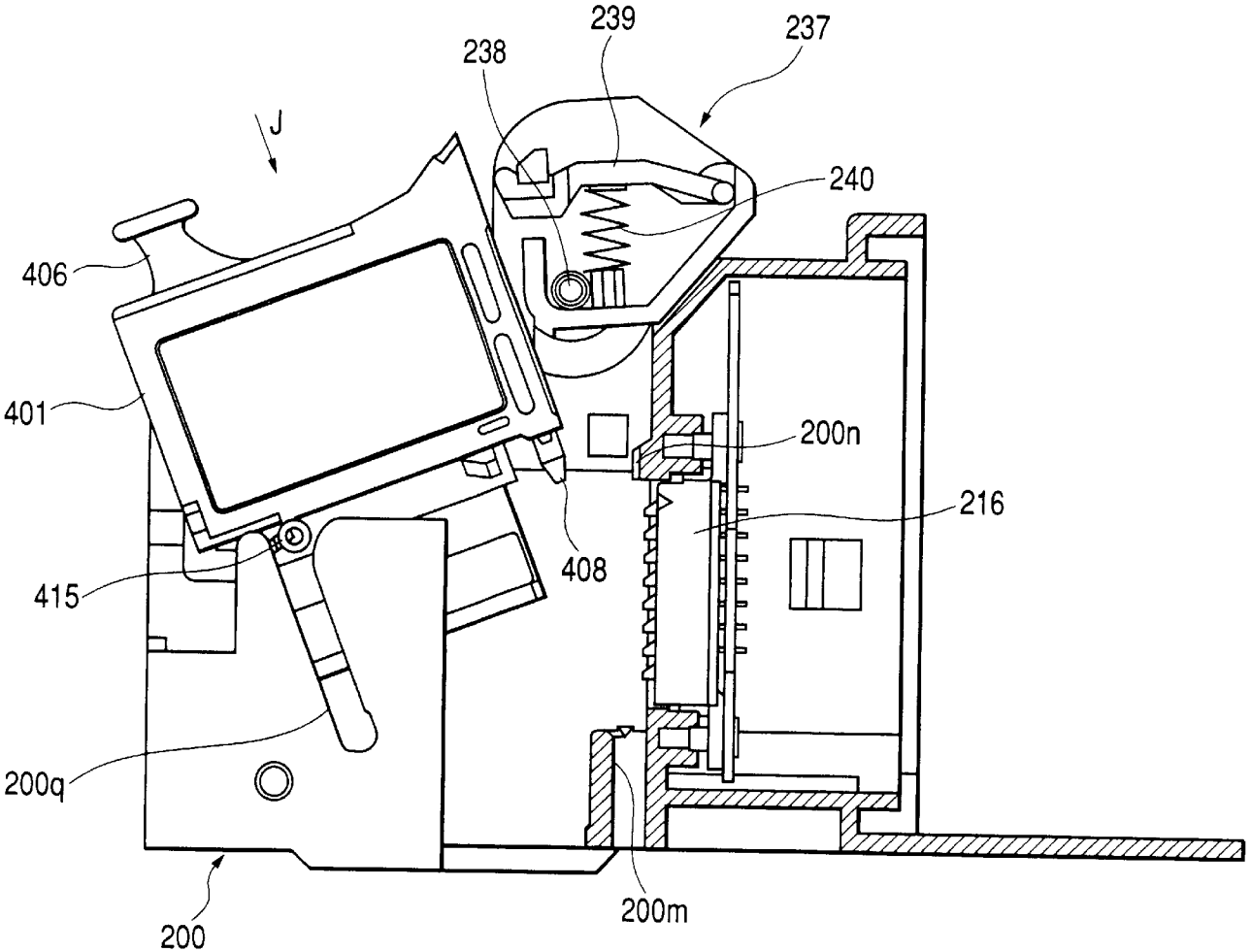
FIG. 8 is a side view which shows the state where the liquid discharge head unit represented in FIG. 1 is mounted on the carriage represented in FIG. 3.
Figure 9:
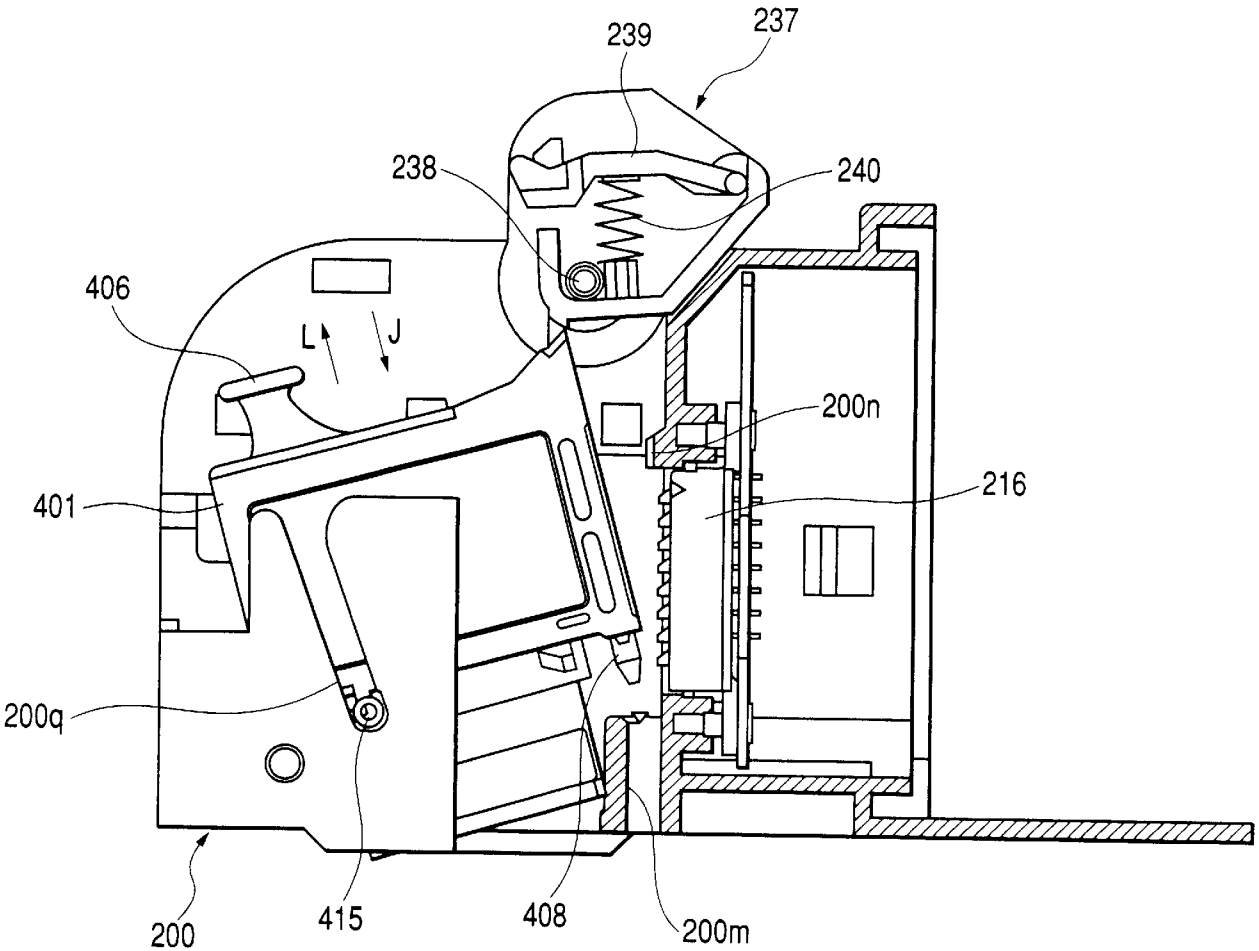
FIG. 9 is a side view which shows the state where the liquid discharge head unit represented in FIG. 1 is mounted on the carriage represented in FIG. 3.
Figure 10:
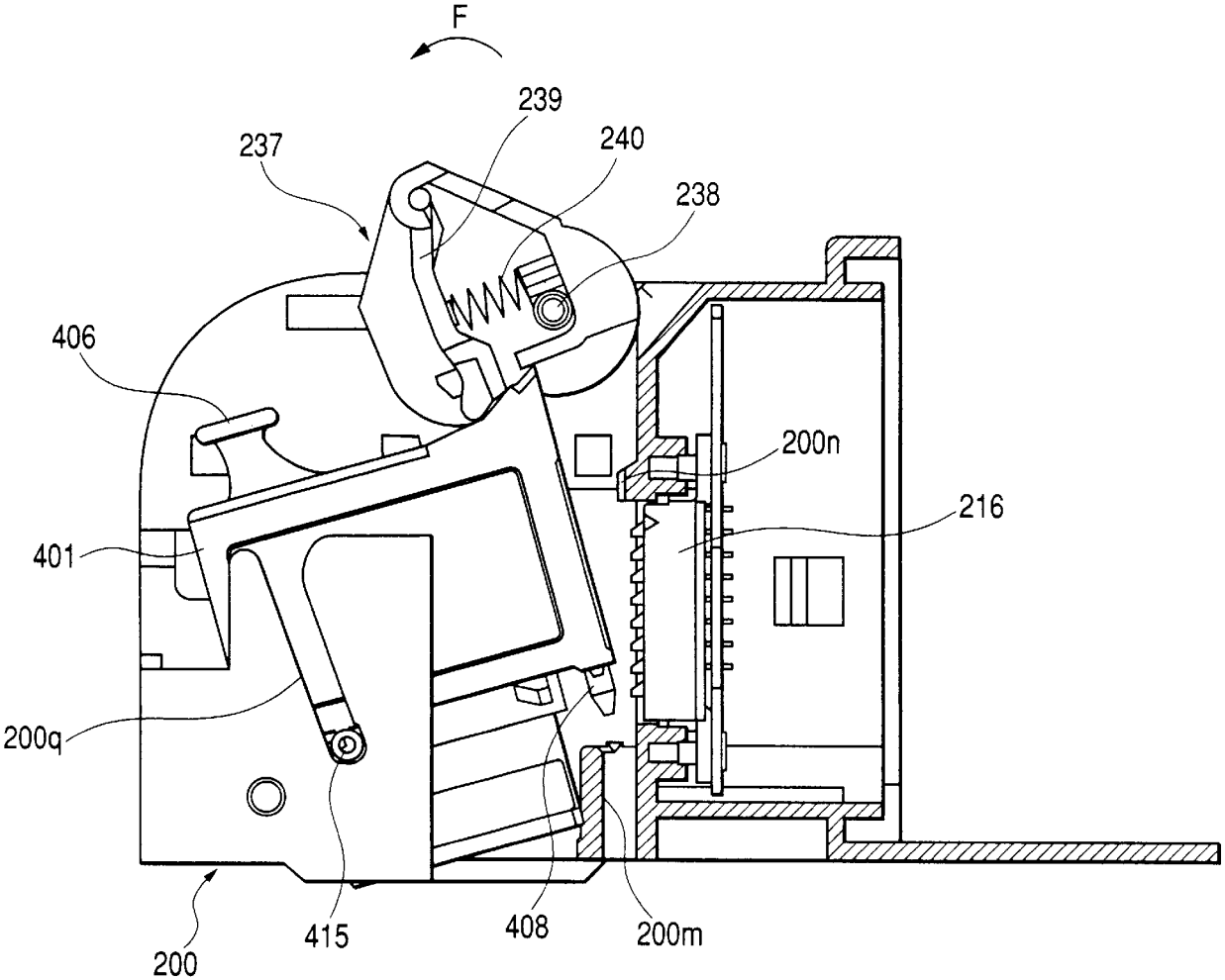
FIG. 10 is a side view which shows the state where the liquid discharge head unit represented in FIG. 1 is mounted on the carriage represented in FIG. 3.
Figure 11:
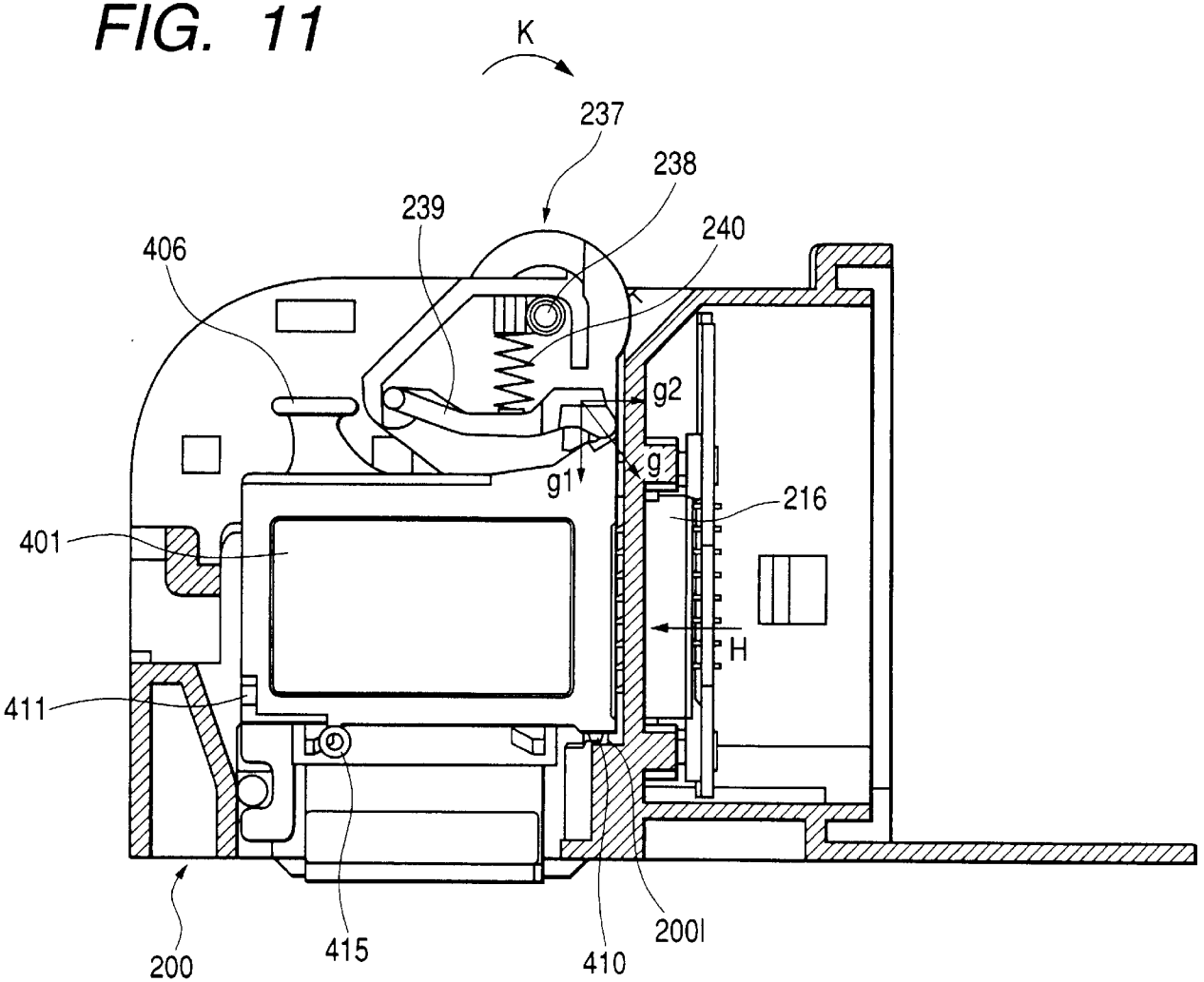
FIG. 11 is a side view which shows the state of the liquid discharge head unit represented in FIG. 1 being mounted on the carriage represented in FIG. 3 by sectioning a part thereof.
Figure 12:
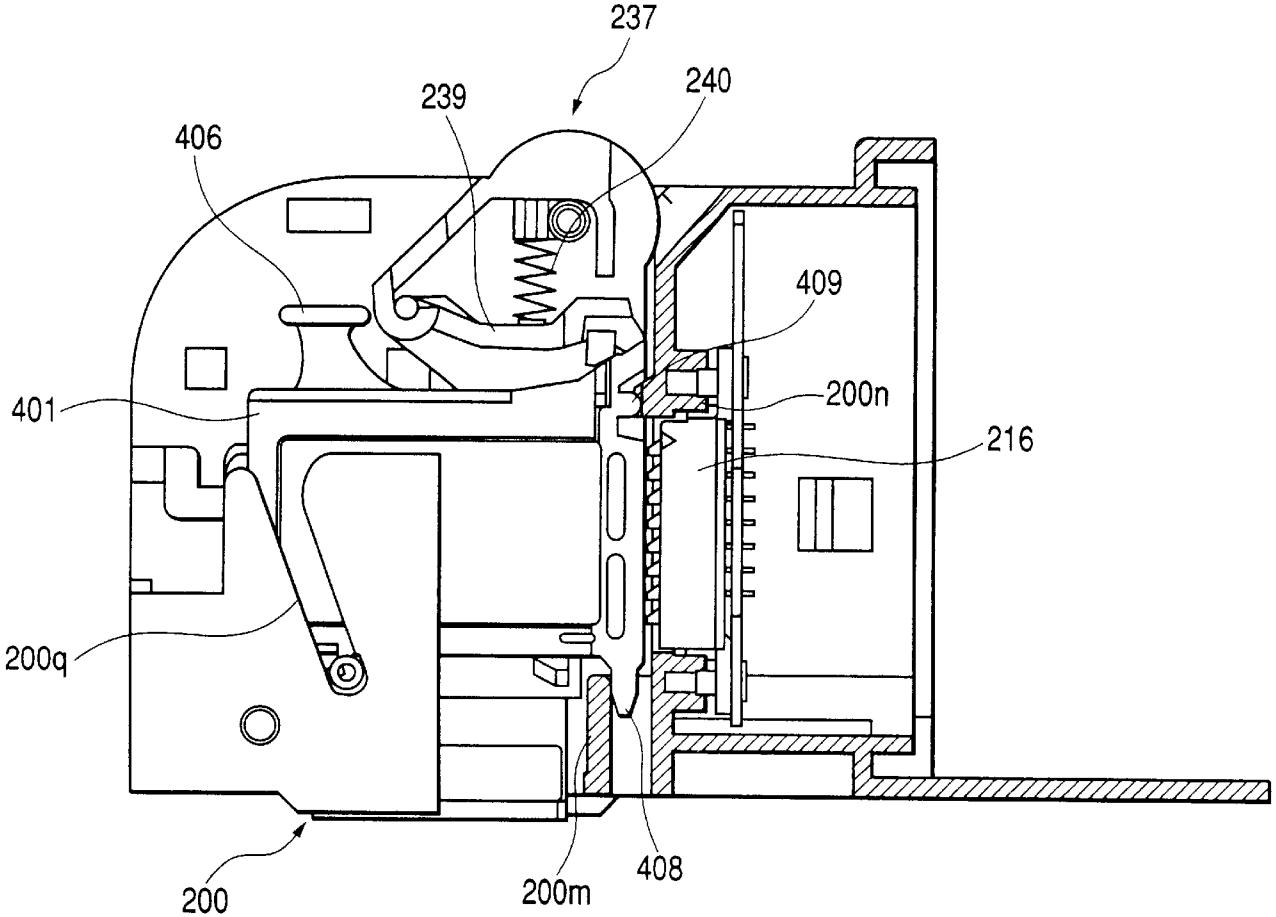
FIG. 12 is a side view which shows the state of the liquid discharge head unit represented in FIG. 1 being mounted on the carriage represented in FIG. 3 by sectioning a different part thereof from the one represented in FIG. 11.

FIG. 1 is a perspective view from the left rear side thereof. FIG. 2 is a perspective view from the right front side thereof. FIG. 3 is a perspective view from the left front side thereof. FIG. 4 and FIG. 5 illustrate the carriage on which the liquid discharge head unit shown in FIGS. 1 to 3 is mounted. FIG. 4 is a perspective view. FIG. 5 is a perspective view from an angle different from the one shown in FIG. 4, which represents the state where the CR lever and CR connector have been removed. FIG. 6 is a perspective view which shows the head set plate incorporated on the carriage represented in FIG. 4 and FIG. 5. FIG. 7 is the enlarged plan view showing the vicinity of the CR connector of the carriage represented in FIG. 4 and FIG. 5. FIG. 8 to FIG. 10 are side views which illustrate the state where the liquid discharge head unit is mounted on the carriage. FIG. 11 and FIG. 12 are side sectional views which illustrate each of the different parts of the state where the liquid discharge head unit is mounted on the carriage. Here, in accordance with the present embodiment, the part name designated by a reference mark CR designate each member correlated to the carriage.

Now, at first, the structure of the liquid discharge head unit 401 will be described. The liquid discharge head unit is provided with ink discharge port group (not shown) on the bottom end thereof. From the bottom toward the upper part, there are formed the ink flow paths (not shown) which are communicated with each of the discharge ports. Above the lower housing thus structured, a housing is connected. In this housing, the ink chamber (not shown) is formed and communicated with each of the ink flow paths. On the front face of the upper housing, the joint portions 416 are arranged to from distributing passages for distributing ink and air when connected with the liquid discharge recording apparatus main body. On the rear side of the upper housing, the contact pads 421 are arranged to be in contact with the CR connector 216 of the carriage 200 for connecting the energy generating elements or the like electrically with the recording apparatus main body for discharging ink. On the upper face of the upper housing, the handle 406 is arranged for handling the liquid discharge head unit 401 when mounting the liquid discharge head unit 401 on the carriage 200.

Next, the description will be made of the structure for positioning the liquid discharge head unit 401. On the left side face of the liquid discharge head unit 401, a columned extrusion 415 is arranged near the front side of the coupling portion between the upper housing and the lower housing, and also, a trapezoidal side extrusion 411 is arranged on the lower front end of the upper housing. On the central part near the upper end of the rear face of the liquid discharge head unit 401 in the widthwise direction, a rear extrusion 409 is arranged with the spherical surface which is convex to the outer side. Near the rear end of the bottom of the upper housing of the liquid discharge head unit 401, there is arranged on the central part thereof in the widthwise direction a columned guide pint 408 having the papered part which becomes thinner toward the leading end from the middle portion thereof, and two downward extrusions 410 are arranged, each with the spherical surface which convex to the outer side near each of the ends in the widthwise direction. On the rear side of the upper face of the liquid discharge head unit 401, guide ribs 407 are arranged, each with a smooth inclination toward the rear side on each end in the widthwise direction, and on the rear side of the guide ribs 407, there is arranged a inclined surface smoothly connected with the inclination of the guide ribs 407 on both sides. Then, further on the rear side, a receiving rib 417, which is inclined downward once to the rear side, and again inclined upward after that, is arranged on the central part in the widthwise direction.

Now, the description will be made of the structure of the carriage 200 to be mounted on the liquid discharge head unit 401.

For the carriage 200, a head unit mounting spacer is arranged for mounting the liquid discharge head unit 401. On the depth side wall of the head unit mounting spacer, a square hole is arranged. On the square hole, is installed the CR connector 216 which performs signal exchanges with the liquid discharge head unit 401. For the CR connector 216, a number of contacts are arranged. Each of the contacts moves forward and backward independently. With the structure thus arranged, when the liquid discharge head unit 401 is mounted on the carriage 200 and the contact portion of the liquid discharge head unit 401 reaches the surface of the contact pads 421, the contacts of the CR connector 216 are withdrawn, and force is exerted on the contacts of the CR connector 216 by the reaction force thereof to push back the contacting portion of the liquid discharge head unit 401 in the direction indicated by an arrow H in FIG. 4 (in the direction from the depth side to the front side).

On the upper part of the carriage 200, a CR lever 237 is rotatively supported by a CR lever shaft 238 supported by the left and right side walls of the carriage 200. For the CR lever 237, a lever unit 237*a* is arranged to rotate the CR lever 237.

For the CR lever 237, a head set plate 239 shown in FIG. 6 is held on a position above the head unit mounting space. It is arrange to provide the head set plate 239 for the liquid discharge head unit 401 one to one. Here, the structure is arranged to mount one carriage 200 on one liquid discharge head unit 401, and one head set plate 239 is provided. However, depending on design, it is possible to change the numbers of liquid discharge head unit 401 and head set plate 239 arbitrarily.

The shafts 239*a* which are arranged on the left and right sides of one end (rear end) of the head set plate 239 are fitted into the U-letter receiver 237*b* provided for the CR lever 237. The head set plate 239 is made rotative centering on this section. Also, on the central part of the head set plate 239, a spring receiver 239*b* is arranged, and a CR set plate spring 240, which is a compression spring, is provided between this section and the spring receiving section arranged on the backside of the CR lever 237. By the function of the CR set plate spring 240, the head set plate 239 is caused to rotate so as to move the leading end portion 239*c* of the head set plate 239, the surface of which is smoothly curved downward, to the lower depth side centering on the shafts 239*a* arranged on the left and right sides on the rear end when the CR set lever 237 rotates to set the liquid discharge head unit 401. In this manner, when the liquid discharge head unit 401 is in the state of being set, the head set plate 239 presses the liquid discharge head unit 401 to the lower depth side. Here, also, in order to prevent the head set plate 239 from being removed from the CR lever 237 in a state where the liquid discharge head unit 401 is not set, a section 237*c* is provided for the CR lever 237 to receive the ribs 239*d* arranged on the left and right sides of the leading end portion of the head set plate 239.

Figure 13:
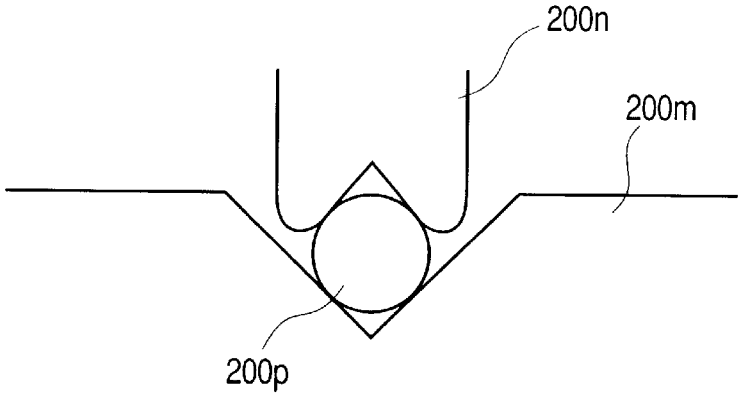
FIG. 13 is an enlarged plan view which shows the vicinity of the CR connector of the carriage, representing the rib configuration that differs from the one shown in FIG. 7.
Figure 14:
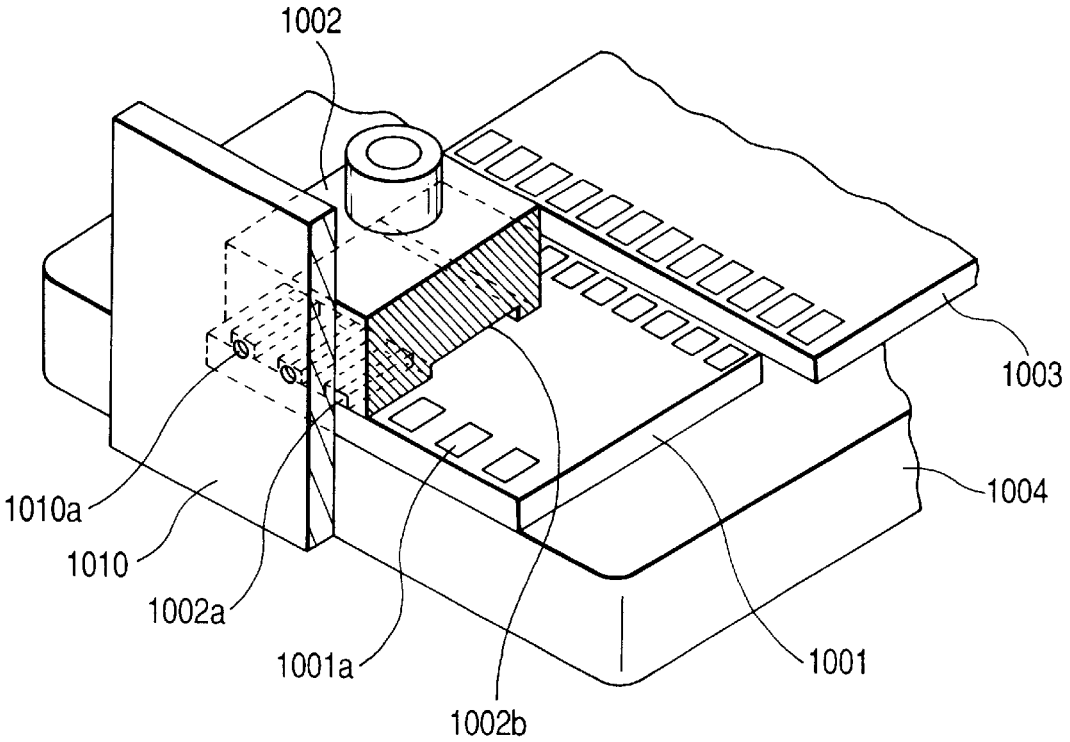
FIG. 14 is a perspective view which shows the conventional example of an ink jet recording head.
Figure 15:
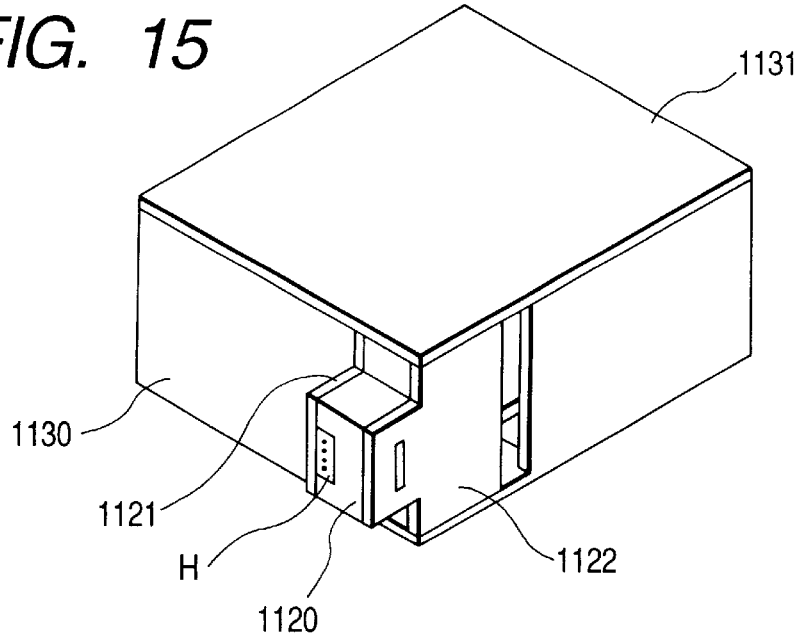
FIG. 15 is a perspective view which shows the conventional example of a liquid discharge head unit.
Figure 16:
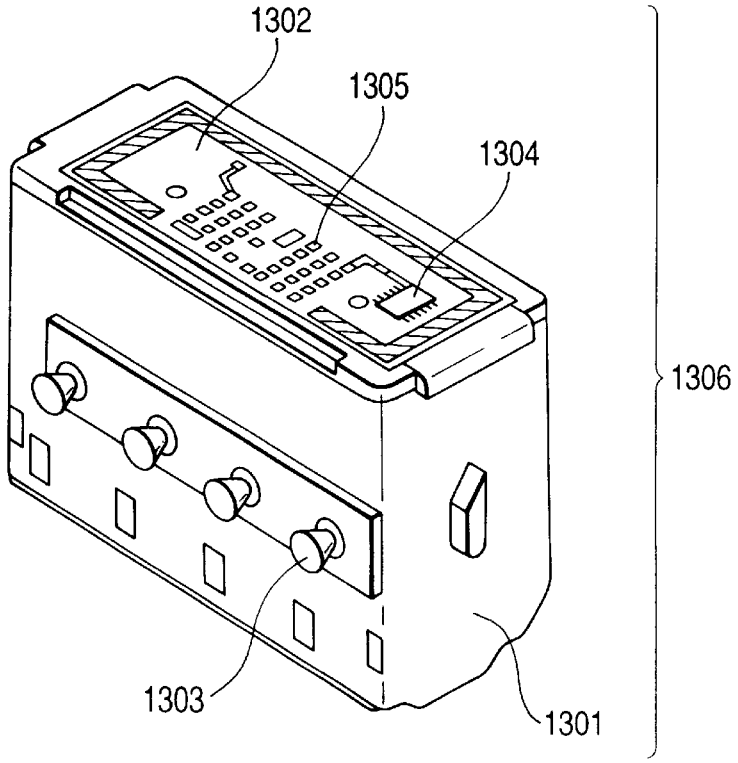
FIG. 16 is a perspective view which shows the conventional example of a recording cartridge of combined head type.
Figure 17:
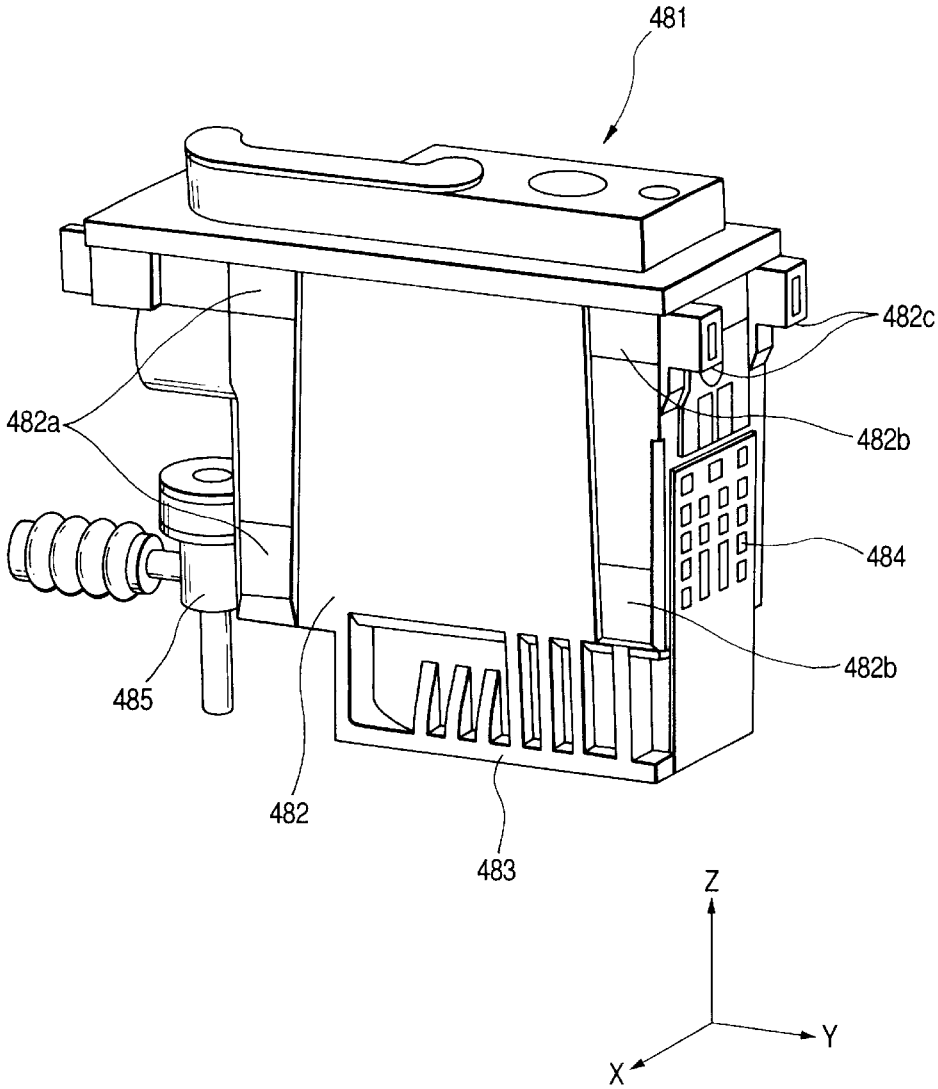
FIG. 17 is a perspective view which shows the conventional example of an ink jet recording cartridge.

On the bottom face of the head unit mounting space of the carriage 200, two conical bosses 2001, having flat upper face each, are arranged for one liquid discharge head unit 401 as shown in FIG. 5. The bosses 2001 are positioned to abut against two lower extrusions 410 arranged for the bottom face of the liquid discharge head unit 401, respectively, when each liquid discharge head unit 401 is set, hence defining the position of the liquid discharge head unit 401 in the height direction. Also, on this bottom face, a first rib portion 200*m*, which is prepared in the U-letter form or the V-letter form as shown in FIG. 13, is arranged for the liquid discharge head unit 401 one to one. In a state where each liquid discharge head unit 401 is set, the side face of a guide pin 408 arranged on the bottom face of each liquid discharge head unit 401 is allowed to abut against the first rib portion 200*m*, respectively.

On the vertical wall of the head unit mounting space of the carriage 200 on the depth side above the CR connector 216, a second rib portion 200*n*, which is prepared in the U-letter form or the V-letter form as shown in FIG. 13, is arranged to face the U-letter or V-letter form first rib portion 200*m*. This portion is structured as shown in FIG. 7 or FIG. 13, observed from above the carriage 200. In other words, the columned section at 200*p* is formed on the portion between the U-letter or V-letter first rib portion 200*m* formed on the bottom face of the carriage 200 and the U-letter or V-letter second rib portion 200*n* arranged on the vertical wall. The U-letter or V-letter second rib portion 200*n* on the vertical wall is arranged on a position to abut against the rear side extrusion 409 having spherical surface arranged above the contact pads 421 of the contact portion on the backside of the liquid discharge head unit 401, when the liquid discharge head unit 401 is set.

On the right side wall of the head unit mounting space of the carriage 200, a guide groove 200*q* is arranged to be extended diagonally from the upper end to the lower depth side. Also, a receiver (not shown) is arranged on a position to abut against the side extrusion 411 of the liquid discharge head unit 401 when the liquid discharge head unit 401 is set. On a position on the side opposite to this receiver, a CR head spring (not shown) is arranged with the liquid discharge head unit 401 between them so as to enable the side extrusion 411 to abut against the receiver. The CR head spring may be arranged on the outer side of the head unit mounting space of the carriage 200, but if a recessed portion is provided on the side opposite to the portion where the side extrusion 411 is arranged for the liquid discharge head unit 401 in order to arrange the CR head spring in such recessed portion, it becomes possible to avoid preparing large arrangement gaps when a plurality of liquid discharge head units 401 are arranged. Also, with the narrower arrangement gaps between a plurality of liquid discharge head units 401, it becomes possible to reduce the correlated positional deviations on recorded images by use of a plurality of liquid discharge head units 401, hence improving the quality of recorded images.

With the structure described above, the positioning in the height direction of the liquid discharge head unit 401 to be mounted on the carriage 200 is made, as shown in FIG. 11 and FIG. 12, by means of the two conical bosses 2001, each having flat upper face, arranged on the bottom face of the carriage 200, which abut against two lower extrusions 410 arranged on the bottom face of the liquid discharge head unit 401 by the application of a component g1 of the force exerted by the head set plate 239 downward to press the receiving rib 417 of the liquid discharge head unit 401.

Also, the front, rear, left, and right sides of the liquid discharge head unit 401 are positioned in such a manner that by the application of the reaction force H (arrow mark) added by the CR connector 216 toward the contact pads 421, and a component g2 of the force added to the receiving rib 417 from the head set plate 239 toward the depth side by means of the CR set plate spring 240 arranged for the CR lever 237 as well, the first rib portion 200*m* arranged in the U-letter or V-letter form on the bottom face of the carriage 200 abuts against the side face of the guide pin 408 arranged on the bottom face of the liquid discharge head unit 401 on the vertical wall on the depth side of the carriage 200, and also, the second rib portion 200*n* arranged in the U-letter or V-letter from abuts against the rear extrusion 409 which has spherical surface and arranged above the contact pads 421 on the backside of the liquid discharge head unit 401. In other words, the front, rear, left, and right sides of the liquid discharge head unit 401 are positioned by fixing the corresponding portions of the liquid discharge head unit 401 to the columned section 200*p* formed and positioned between the first rib portion 200*m* and the second rib portion 200*n* to face each other as shown in FIG. 7 or FIG. 13, which are prepared in the U-letter or V-letter form on the bottom face of the carriage 200 and the vertical wall on the depth side, respectively, in accordance with the present embodiment.

In this case, the contact between the guide pin 408 and the first rib portion 200*m* is by the cylindrical surface, and the flat faces of the U-letter or V-letter from, while the contact between the rear extrusion 409 and the second rib portion 200*n* by the spherical surface and the flat faces of the U-letter or V-letter form. Then, by pressure exerted by the CR set plate spring 240 and the contacts of the CR connector 216, force may work in the direction in which deviation is corrected against the positional deviation in the front, rear, left and right of the liquid discharge head unit 401, thus making it possible to operate stabilized positioning. The front, rear, left, and right positioning of the liquid discharge head unit 401 is made in high precision with the provision of good reproducibility.

Also, the lower left and right positions of the liquid discharge head unit 401 are regulated by the guide pin 408 that abuts against the first rib portion 200*m*. The upper left and right positions thereof are regulated to be in agreement with the lower positions by the rear extrusion 409 that abuts against the second rib portion 200*n*. Thus, the structure is arranged to perform positional regulations from the positions apart from each other vertically so as to make it possible to minimize the inclination of the liquid discharge head unit 401 to the left and right in the height direction thereof, as well as to keep such condition reliably as it is. Since the inclination of the liquid discharge head unit 401 to the left and right can be made small in the height direction, the lower extrusion 410 abuts against the boss 2001 reliably without conditioning to allow only one side thereof to be in contact with the boss 2001. As a result, it is possible for the liquid discharge head unit 401 to effectuate highly precise positioning in the height direction thereof.

The liquid discharge head unit 401 is rotative, although the front, rear, left, and right positions thereof are regulated by the contact between the columned face of the guide pin 408 and the first rib portion 200*m*, and the contact between the spherical surface of the rear extrusion 409 and the second rib portion 200*n*. In this case, friction takes place each contact surface by the pressure which is exerted by the component g2 of force added from the CR set plate 239, and the reaction force H of the CR connector as well. However, each contact area is small, and the resultant friction is comparatively small. Also, friction takes place on the contact surface between the lower extrusion 410 and the boss 2001, and the contact surface between the CR set plate 239 and the receiving rib 417 due to pressure exerted by the component g1 of force added from the CR set plate 239. However, the contact between the lower extrusion 410 and the boss 2001 is by the spherical surface and flat face, and the width of the receiving rib 417 is narrow. Each contact area is small, and the resultant friction comparatively small. Therefore, it is possible to rotate the liquid discharge head unit 401 with a comparatively small force centering on the columned section at 200*p* even in a state where the front, rear, left, and right sides thereof are regulated. Here, it is desirable to make the width of the receiving rib 2 mm or less in particular.

In this way, the liquid discharge head unit 401 is made rotative centering on the columned section at 200*p*, and positioned in the rotational direction of the liquid discharge head unit 401 (inclination to the arrangement direction of discharge ports of the head) by means of contact between the trapezoidal side extrusion 411, which is arranged on the lower front part of the liquid discharge head unit 401, and the receiver arranged on the front side of the carriage 200 by use of the CR head spring 201 arranged on the front side of the carriage 200. Here, the pressure of the CR head spring is added to the columned section at 200*p* of the liquid discharge head unit 401 that rotates, that is, the essentially forefront position of the liquid discharge head unit 401 with respect to the rotational center formed on the essentially rearmost position of the liquid discharge head unit 401. In other words, this pressure is exerted on the essentially outermost circumferential position of rotation. As a result, owing to the principle of leverage, it becomes possible to regulate the position in the rotational direction firmly with a small load. Also, the rotational position is regulated on the essentially outermost circumferential position of the liquid discharge head unit 401 that rotates, that is, the rotational position is regulated between comparatively long holding points at the essentially forefront and rearmost positions of the liquid discharge head unit 401, hence making it possible to define the position in the rotational direction in high precision.

In accordance with the present embodiment, each contact face of the rear extrusion 409, the guide pin 408, and the lower extrusion 410, with which to define the position of the liquid discharge head unit 401 exactly, is spherical or column. Here, the structure is arranged to perform positioning by means of contact between a curved face and flat face.

Therefore, the contacting state is not easily affected by deviation in the contacting direction due to distortion of the liquid discharge head unit 401 and the carriage 200 or due to difference in contacting force or the like. Thus, the liquid discharge head unit 401 can be positioned in high precision with good reproducibility. As to the side extrusion 415, it is preferable to arrange the structure likewise. More specifically, it is preferable to prepare the side extrusion in a trapezoidal form as in the present embodiment or the plane of the side extrusion 415 which should be in contact with the receiver is in a spherical, curved, or polygonal form.

Now, with reference to FIG. 8 to FIG. 12, the description will be made of the installation procedure for the liquid discharge head unit 401.

At first, The CR lever shaft 238 supported on the left and right side walls of the carriage 200 is rotated centering on the CR lever 237, and as shown in FIG. 8, the CR lever 237 is placed to be positioned upward so that the liquid discharge head unit 401 can be inserted into the carriage 200. From this state, the liquid discharge head unit 401 is inserted from the front side of the carriage 200 in the direction indicated by an arrow J, while holding with a hand the handle 406 arranged on the upper part of the liquid discharge head unit 401 so as to place the discharge ports diagonally downward.

When the liquid discharge head unit 401 is further inserted, the columned extrusion 415 arranged on the left side face of the liquid discharge head unit 401 advances into the guide groove 200*q* for use of head unit insertion guide which is provided for the right side wall of the head unit insertion space of the carriage 200 as shown in FIG. 9. Then, as the liquid discharge head unit 401 is further inserted in the depth direction, the liquid discharge head unit 401 is contained in the head unit insertion space of the carriage 200, while being guided by the guide groove 200*q*. Thus, the trapezoidal side extrusion 411 arranged on the lower front of the side face of the liquid discharge head unit 401 is inserted into the gap between the receiver and CR head spring 201. At this juncture, the liquid discharge head unit 401 still presents a forward-bent posture.

When the liquid discharge head unit 401 is inserted into the head unit insertion position of the carriage 200, the CR lever 237 is rotated in the direction indicated by an arrow F centering on the CR lever shaft 238 as shown in FIG. 10. Then, the leading end portion 239*c* of the head set plate 239 (see FIG. 6) held by the CR lever 237 slides on the slope having smooth upper face of each guide rib 407, of the liquid discharge head unit 401, while pressing it. The liquid discharge head unit 401 is pushed in toward the backside, while being raised and rotated centering on the columned extrusion 415. At this juncture, the unsteadiness of the liquid discharge head unit 401 is controlled so as not to be inclined to the left or right in the vertical direction, because the leading end portion 239*c* of the head set plate 239 presses the upper face of the guide ribs 407 arranged in the widthwise direction on both ends of the upper face of the liquid discharge heat unit. Also, with the columned extrusion 415 being rotated in a state of being in contact with the guide groove 200*q*, the rotation locus of the liquid discharge head unit 401 is regulated to enable the guide pin 408 to advance diagonally toward the first rib portion 200*m* so that the first rib portion 200*m* is exactly guided to the appropriate position where the side face of the guide pin 408 can abut against it. Also, likewise, the lower extrusion 410 of the liquid discharge head unit 401 can be guided exactly to the position where it abuts against the boss 2001, and the rear extrusion 409 to the position where it abuts against the second rib portion 200*n*.

In this case, the guide ribs 407 are arranged so as to make each distance equal from the center of the receiving rib 417 to the guide ribs 407 on both ends in the widthwise direction, respectively. Then, the moment of inclination to the left and right is equalized for the liquid discharge head unit 401 in the vertical direction, thus effectively controlling the unsteadiness of the liquid discharge head unit 401 so as not to be inclined to the left or right in that direction.

With the liquid discharge head unit 401 being raised in this manner by the rotation of the CR lever 237, the leading end portion 239*c* of the head set plate 239 arrives at the rear inclination of the guide ribs 407, and with further rotation, this portion rides over beyond this inclination to abut against the receiving rib 417 for fixation. In this way, the liquid discharge head unit 401 is firmly held so as not to move to the front, rear, left, and right, and up and down, either. Here, the guide ribs 407 and the receiving rib 417 are smoothly connected to be able to rotate the liquid discharge head unit 401 smoothly with the smoothly curved surface of the leading end portion 239*c*.

When the CR lever 238 abuts against the receiving rib 417 in this manner, the contact pads 421 of the liquid discharge head unit 401 is allowed to abut against the CR connector 216. The guide pin 408 is exactly in contact with the first rib portion 200*m* by means of the reaction force H exerted by the contacts of the CR connecter 216. The rear extrusion 409 is exactly in contact with the second rib portion 200*n* by means of the component g2 of force exerted by the head set plate 237 so as to guide the liquid discharge head unit 401 to the front, rear, left, and right positions appropriately. Thus, the contact pads 421 are allowed to move diagonally toward the CR connector 216 to abut against it. Therefore, there is almost no possibility that the contact pads 421 and the CR connector 216 are caused to rub each other. Also, the lower extrusion 410 of the liquid discharge head unit 401 is exactly in contact with the boss 2001 by means of the component g1 of form exerted by the head set plate 237 so that the liquid discharge head unit 401 is guided to the appropriate upper and lower positions. The side extrusion 411 of the liquid discharge head unit 401 is exactly in contact with the receiver by the pressure of the CR head spring so that the liquid discharge head unit 401 is guided to a position which is appropriately angled.

In this way, as shown in FIG. 11 and FIG. 12, the liquid discharge head unit 401 is contained in the head unit mounting space of the carriage 200, and held in a state of having been guided to the appropriate positions, hence completing the mounting of the liquid discharge head unit 401 on the carriage 200.

As described above, by use of the ink jet recording apparatus embodying the present invention, it becomes possible to mount the narrow liquid discharge head unit 401 on the carriage 200 in high precision. In this case, pressure needed for positioning can be small as described earlier. As a result, it is unnecessary to make robustness very large for the liquid discharge head unit 401 and carriage 200. Thus, the weight of the liquid discharge head unit 401 and carriage 200 made lighter so as to operate carriage scanning faster. Also, there is almost no possibility that the contact pads 421 and CR connector 216 are allowed to rub each other, hence almost no friction being generated.

In this respect, the present embodiment describes the structure in which one liquid discharge head unit 401 is arranged for the carriage 200, but this structure can be made the one in which a plurality of liquid discharge head units 401 can be arranged. Then, in the latter case, too, each of the liquid discharge head units 401 can be positioned in high precision to make it possible to enhance the correlated positional precision for plural liquid discharge head units 401. With such arrangement, it becomes possible to from color images in high image quality by superposing image of plural colors in high precision. In this instance, each of the plural liquid discharge head units 401 can be held individually. Therefore, should liquid discharge head units 401 are replaced partly, only the corresponding unit or units can be removed for replacement. As compared with the conventional combined head type, the maintenance costs can be suppressed to a lower level. Also, as compared with the combined head type, the production yield can be enhanced.

As described above, in accordance with the present invention, it becomes possible to position and mount a narrow liquid discharge head unit on a carriage in high precision.

Particularly, the guide ribs pressed by the liquid discharge head unit that rotates to be mounted are arranged on both upper side ends of the liquid discharge head unit or in the vicinity of both side ends. With this arrangement, it becomes possible to effectively control the unsteadiness of the liquid discharge head unit so as not to be inclined to the left and right in the vertical direction when it is rotated.

Also, the contact pads of the liquid discharge head unit rotates to be in contact with the CR connector of the carriage. Therefore, the contact pads and CR connector are rarely allowed to rub each other to cause frictional wear.

Also, the positional contacts are those performed by each contact between a spherical, curved, or polygonal surface and a flat surface, respectively. Thus, the contacts can be made stably with positioning made in highly precise reproducibility.

Also, the structure is arranged so that the liquid discharge head unit is positioned and held on the rear side thereof by the contact between the bottom face guide pin and the rear extrusion on the backside which are positioned apart from each other vertically. With this arrangement, it becomes possible to minimize the inclination of the liquid discharge head unit to the left and right in the vertical direction, and at the same time, to keep it in this state reliable. Also, with this arrangement, the lower extrusion is allowed to abut against bosses exactly to make highly precise positioning possible for the liquid discharge head unit in the height direction.

Also, the structure is arranged so that when the liquid discharge head unit rotates around the center shaft of the guide pin, the pressure of rotating CR head spring is allowed to act upon the outer circumferential position away from the rotational center. Therefore, owing to the principle of leverage, it becomes possible to regulate positions firmly in the rotational direction with a small amount of load. Here, the structure is also arranged to regulate the rotation of the liquid discharge head unit from two positions apart from each other forward and backward. As a result, the positioning in the rotational direction is effectuated in high precision, and the positions thus obtained are kept exactly.

As described above, in accordance with the present invention, the inclination of a liquid discharge head unit can be adjusted in high precision for arrangement thereof.

In accordance with the present invention, the CR head spring can be arranged with almost no projection from the width of a liquid discharge head unit by making the corresponding positions thinner for the liquid discharge head unit. There is no resultant component that may project in the widthwise direction among those arranged for the liquid discharge head unit. This makes it possible to arrange a plurality of liquid discharge head units at short pitches in the widthwise direction. Thus, the arrangement space for the liquid discharge head units can be made smaller accordingly. This may also lead to the enhancement of quality of recorded images.

The CR head spring and CR set plate spring are arranged in such a manner as to create almost no hindrance to occur between them when pressures are exerted. Thus, it becomes possible to dispense with a smaller amount of pressure when it should be exerted.

With advantages described above, the carriage can be made lighter and therefore movable at a higher speed.

In accordance with the present invention, it is possible to position and mount a liquid discharge head unit in high precision. Therefore, with the application of the invention to a liquid discharge recording apparatus structured to mount a plurality of liquid discharge head units on one carriage, it becomes possible to suppress costs of maintenance, and also, to make the production yield high as compared with the one that uses the liquid discharge head unit of combined head type.

What is claimed is:

1. A liquid discharge recording apparatus provided with a liquid discharge head for discharging liquid droplets from a plurality of discharge ports to record on a recording medium, a liquid discharge head unit integrally formed with a housing to hold said liquid discharge head, and a carriage capable of detachably mounting said liquid discharge head unit thereon, wherein said liquid discharge head unit comprises a columned guide pin arranged in the central portion of a rear bottom face of said liquid discharge head unit in a widthwise direction to be extended downward, a rear extrusion arranged in a central portion of an upper backside face of said liquid discharge head unit in a widthwise direction, having a spherical surface convex toward a rear side of said liquid discharge head unit, a columned extrusion and a side extrusion arranged on a front part of a side face of said liquid discharge head unit, a pair of guide ribs arranged on two side ends or in a vicinity of said two side ends on an upper rear portion of said liquid discharge head unit to face each other, each having an inclined upper surface made higher toward the rear side of said liquid discharge head unit, and a receiving rib arranged in a central portion on said upper rear portion of said liquid discharge head unit in a widthwise direction, being connected with said guide ribs on a rear side of said guide ribs, and having an inclined surface lowered once, and then, made higher toward said rear side of said liquid discharge head unit, and said carriage comprises a guide groove capable of sliding said liquid discharge head unit in a state of being in contact with said columned extrusion to be guided into a head unit mounting space, and holding said unit in such position rotatively centering on said columned extrusion, a head set plate for pressing said upper surface of said guide ribs so as to effectuate substantially horizontal movement of a pressurized position of said liquid discharge head unit from a front side to said rear side of said liquid discharge head unit at a time of being mounted on said carriage, and pressing said receiving rib after said liquid discharge head unit is mounted on said carriage, a first rib portion in U-letter or V-letter form to abut against a face of said guide pin in a state of said liquid discharge head unit being mounted on said carriage, a second rib portion in U-letter or V-letter form to abut against said spherical surface of said rear extrusion, a receiver abutting against said side extrusion, and a CR head spring to press said liquid discharge head unit to enable said side extrusion to abut against said receiver.

2. A liquid discharge recording apparatus according to claim 1, wherein said guide ribs are arranged to equalize each distance from the center of said receiving rib in the widthwise direction to each of said guide ribs on both side ends in the widthwise direction.

3. A liquid discharge recording apparatus according to claim 1, wherein said guide ribs and said receiving rib are connected smoothly.

4. A liquid discharge recording apparatus according to claim 2, wherein said guide ribs and said receiving rib are connected smoothly.

5. A liquid discharge recording apparatus according to either one of claim 1 to claim 4, wherein said head set plate is provided with the leading end portion extruding downward, a shaft formed on the rear portion, and a spring receiver formed on the upper surface;

a CR lever for supporting the shaft of said head set plate rotatively in the vicinity of the lower leading end, while being supported rotatively around the axis of CR lever shaft arranged on the foot thereof, to guide said head set plate to a position to be in contact with the upper surface of said liquid discharge head unit; and a CR set plate spring connected with the bottom face of said CR lever, and said spring receiver of said head set plate.

6. A liquid discharge recording apparatus according to either one of claim 1 to claim 4, wherein said liquid discharge head unit is capable of rotating, while keeping the state of said guide pin being in contact with said first rib portion, and said rear extrusion being in contact with said second rib portion.

7. A liquid discharge recording apparatus according to either one of claim 1 to claim 4, wherein the center of said spherical surface of said rear extrusion is positioned on the extended line of the center line of the column of said guide pin.

8. A liquid discharge recording apparatus according to claim 7, wherein said liquid discharge head unit is rotative around the center line of said column of said guide pin as axis.

9. A liquid discharge recording apparatus according to claim 7, wherein the center of said receiving rib in the widthwise direction is positioned on the extended line of the center line of said column of said guide pin.

10. A liquid discharge recording apparatus according to claim 7, wherein the width of said receiving rib is 2 mm or less.

11. A liquid discharge recording apparatus according to either one of claim 1 to claim 4, wherein said liquid discharge head unit is provided with a lower extrusion arranged on the rear side of the bottom face, having spherical surface convexly downward, and said carriage is provided with a boss having flat upper face to abut against said spherical surface of said side extrusion in a state of said liquid discharge head unit being mounted on said carriage.

12. A liquid discharge recording apparatus according to either one of claim 1 to claim 4, wherein said guide pin is provide with tapered portion becoming narrower toward the leading end.

13. A liquid discharge recording apparatus according to either one of claim 1 to claim 4, wherein said liquid discharge head unit is provided with contact pads formed on the backside thereof for electrical connection, and said carriage is provided with a CR connector to be connected with said contact pads.

14. A liquid discharge recording apparatus according to either one of claim 1 to claim 4, wherein the abutting surface of said side extrusion against said receiver is one face formed in sphere, curve, or polygon.

15. A liquid discharge head unit detachably mountable on a carriage of a liquid discharge recording apparatus main body integrally formed with a liquid discharge head for discharging liquid droplets from a plurality of discharge ports to record on a recording medium, and a housing to hold said liquid discharge head unit, comprising:

a columned guide pin arranged in a central portion of a rear bottom face of said liquid discharge head unit in a widthwise direction to be extended downward;

a rear extrusion arranged in a central portion of an upper backside face of said liquid discharge head unit in a widthwise direction, having a spherical surface convex toward rear side of said liquid discharge head unit;

a columned extrusion and a side extrusion arranged on a front part of a side face of said liquid discharge head unit;

a pair of guide ribs arranged on two side ends or in a vicinity of said two side ends on an upper rear portion of said liquid discharge head unit to face each other, each having an inclined upper surface made higher toward said rear side of said liquid discharge head unit; and a receiving rib arranged in a central portion on said upper rear portion of said liquid discharge head unit in a widthwise direction, being connected with said guide ribs on a rear side of said guide ribs, and having an inclined surface lowered once, and then, made higher toward said rear side of said liquid discharge head unit, wherein said columned extrusion supports said liquid discharge head unit rotatively with said columned extrusion as an axis, said guide ribs enable said liquid discharge head unit to rotate with said columned extrusion as the axis so as to be guided to an appropriately angled position, while an upper surface of said guide ribs is pressed to effectuate substantially horizontal movement of a pressurized position of said liquid discharge head unit from a front side to said rear side of said liquid discharge head unit, said receiving rib enables said liquid discharge head unit to be pressed toward a diagonally lower rear side of said liquid discharge head unit when the pressurized position moves further to said rear side of said liquid discharge head unit to arrive at an upper surface thereof, and enables a side face of said guide pin to abut against said spherical surface of said rear extrusion, said guide pin and said rear extrusion enable the front side, the rear side, a left side and a right side of said liquid discharge head unit to be positioned exactly when said side face of said guide pin and said spherical surface of said rear extrusion abut against said carriage, and at the same time, hold said liquid discharge head unit rotatively while keeping the abutting condition thereof, and said side extrusion enables said liquid discharge head unit to abut against said carriage to make the angled position appropriately in a rotational direction when said side face of said guide pin and said spherical surface of said rear extrusion rotate while keeping the abutting condition.

16. A liquid discharge head unit according to claim 15, wherein said guide ribs are arranged to equalize each distance from the center of said receiving rib in the widthwise direction to each of said guide ribs on both side ends in the widthwise direction.

17. A liquid discharge head unit according to claim 15, wherein said guide ribs and said receiving rib are connected smoothly.

18. A liquid discharge head unit according to claim 16, wherein said guide ribs and said receiving rib are connected smoothly.

19. A liquid discharge head unit according to either one of claim 16 to claim 18, wherein the center of said spherical surface of said rear extrusion is positioned on the extended line of the center line of the column of said guide pin.

20. A liquid discharge head unit according to claim 19, wherein said liquid discharge head unit is rotative around the center line of said column of said guide pin as axis.

21. A liquid discharge head unit according to claim 19, wherein the center of said receiving rib in the widthwise direction is positioned on the extended line of the center line of said column of said guide pin.

22. A liquid discharge head unit according to claim 19, wherein the width of said receiving rib is 2 mm or less.

23. A liquid discharge head unit according to either one of claim 15 to claim 18, wherein said liquid discharge head unit is provided with a lower extrusion arranged on the rear side of the bottom face, having spherical surface convexly downward, to abut against said carriage for positioning the liquid discharge head unit exactly in the vertical direction.

24. A liquid discharge head unit according to either one of claim 15 to claim 18, wherein said guide pin is provide with tapered portion becoming narrower toward the leading end.

25. A liquid discharge head unit according to either one of claim 15 to claim 18, wherein said liquid discharge head unit is provided with contact pads formed on the backside thereof for electrical connection.

26. A liquid discharge head unit according to either one of claim 15 to claim 18, wherein the abutting surface of said side extrusion against said carriage is one face formed in sphere, curve, or polygon.

27. A method for mounting a liquid discharge head unit on a liquid discharge recording apparatus according to either one of claim 1 to claim 4, comprising the following steps of:

inserting said liquid discharge head unit into a head unit mounting space by sliding said columned extrusion in a state of being in contact with said guide groove;

rotating said liquid discharge head unit around said columned extrusion as axis by pressing the upper surface of said guide ribs by said head set plate so as to effectuate the substantially horizontal movement of the pressurized position from the front side to the rear side;

pressing the upper surface of said receiving rib lastly by means of said head set plate by moving said pressurized position further in order to enable the side face of said guide pin to abut against said first rib portion, and said spherical surface of said rear extrusion to abut against said second rib portion; and pressing subsequently the side face of said liquid discharge head unit by use of said CR spring to rotate said liquid discharge head unit around the column of said guide pin with the center line thereof as axis for enabling said side extrusion to abut against said receiver.

* * * * *

UNITED STATES PATENT AND TRADEMARK OFFICE

CERTIFICATE OF CORRECTION

PATENT NO. : 6,435,663 B2 
DATED : August 20, 2002
INVENTOR(S) : Yukuo Yamaguchi et al.

It is certified that error appears in the above-identified patent and that said Letters Patent is hereby corrected as shown below:

Column 1,
Line 57, “is energy” should read -- is an energy --.

Column 3,
Line 18, “an” should read -- a --.

Column 6,
Line 65, “should be is” should read -- is --.

Column 9,
Line 55, “provide” should read -- provided --; and
Line 56, “tapered” should read -- a tapered --.

Column 12,
Lines 20 and 23, “is,” should read -- is defined as --; and
Line 58, “from” should read -- form --.

Column 13,
Line 14, “pint 408 having a papered” should read -- pin 408 having a tapered --;
Line 23, “a” should read -- an --;
Line 35, “hole,” should read -- hole, there --; and
Line 56, “arrange” should read -- arranged --.

Column 15,
Line 46, “from,” should read -- form, --; and
Line 48, “200*n* by” should read -- 200*n* is by --.

Column 19,
Line 8, “are” should read -- be --.

Column 20,
Lines 31 and 56, “comprises” should read -- comprises: --; and
Line 47, “the” should read -- said --.

Column 21,
Lines 24, 38, 45 and 61, “either” should read -- any --.

Column 22,
Lines 2, 5 and 11, “either” should read -- any --;
Line 3, “provide with tapered” should read -- provided with a tapered--; and
Line 26, “toward rear” should read -- toward a rear --.

UNITED STATES PATENT AND TRADEMARK OFFICE

CERTIFICATE OF CORRECTION

PATENT NO. : 6,435,663 B2
DATED : August 20, 2002
INVENTOR(S) : Yukuo Yamaguchi et al.

It is certified that error appears in the above-identified patent and that said Letters Patent is hereby corrected as shown below:

Column 23,
Lines 18 and 31, “either” should read -- any --.

Column 24,
Lines 1, 4, 7 and 12, “either” should read -- any --;
Line 2, “provide with” should read -- provided with --; and
Line 3, “tapered” should read -- a tapered --.

Signed and Sealed this

Twenty-second Day of April, 2003

JAMES E. ROGAN
*Director of the United States Patent and Trademark Office*